United States Patent [19]

Oguagha

[11] 4,196,104

[45] Apr. 1, 1980

[54] PROCESS FOR PRODUCING ANTISTATIC, FABRIC-SOFTENING DETERGENT COMPOSITION

[75] Inventor: Patrick C. Oguagha, Cincinnati, Ohio

[73] Assignee: The Procter & Gamble Company, Cincinnati, Ohio

[21] Appl. No.: 945,366

[22] Filed: Sep. 25, 1978

Related U.S. Application Data

[63] Continuation-in-part of Ser. No. 836,811, Sep. 26, 1977, abandoned.

[51] Int. Cl.[2] ..... C11D 7/32; C11D 17/00; C11D 11/00

[52] U.S. Cl. ..... 252/542; 252/8.75; 252/8.8; 252/528; 252/547; 252/545; 252/550; 252/551; 252/558

[58] Field of Search ..... 252/8.75, 8.8 R, 8.8 AJ, 252/528, 542, 547; 427/242

[56] References Cited

U.S. PATENT DOCUMENTS

| | | | |
|---|---|---|---|
| 3,607,763 | 9/1971 | Salmen et al. | 252/547 X |
| 3,703,480 | 11/1972 | Grand et al. | 252/524 |
| 3,862,058 | 1/1972 | Nirschl et al. | 252/528 |
| 3,936,537 | 2/1976 | Baskerville et al. | 427/242 |
| 3,954,632 | 5/1976 | Gloss | 252/8.8 |
| 3,959,155 | 5/1976 | Montgomery et al. | 252/8.8 |
| 3,966,629 | 6/1976 | Dumbrell | 252/140 |

FOREIGN PATENT DOCUMENTS 1053388 12/1966 United Kingdom

*Primary Examiner*—P. E. Willis, Jr.
*Attorney, Agent, or Firm*—Robert B. Aylor; Richard C. Witte; Thomas H. O'Flaherty

[57] ABSTRACT

Detergent-compatible antistatic compositions are sprayed onto base detergent granules containing surfactant, detergency builders, and other detergency additives, to form discrete particles with distinct properties.

31 Claims, 2 Drawing Figures

PROCESS FOR PRODUCING ANTISTATIC, FABRIC-SOFTENING DETERGENT COMPOSITION

CROSS REFERENCE TO RELATED APPLICATION

This application is a continuation-in-part of co-pending application Ser. No. 836,811, Patrick Chilozie Oguagha, for ANTISTATIC, FABRIC-SOFTENING DETERGENT COMPOSITION AND METHOD FOR PRODUCING SAME, filed Sept. 26, 1977, now abandoned.

BACKGROUND OF THE INVENTION

This invention relates to detergency compositions where intimate mixtures of quaternary ammonium compound and organic dispersion inhibitor are attached to granules containing conventional detergent components. More particularly, this invention relates to spraying molten intimate mixtures of quaternary ammonium compounds and organic dispersion inhibitors onto spray-dried detergent granules to form discrete, distinct particles with fabric-softening, antistatic capabilities.

Various quaternary ammonium compounds are known in the art to possess antistatic properties. These quaternary ammonium compounds are known to be incompatible with anionic surfactants commonly employed in laundering compositions. Anionic surfactants attack and inactivate the quaternary ammonium compounds in solution (by forming insoluble salts). It therefore becomes a problem of shielding the quaternary ammonium compounds in the wash water environment, without disturbing their effectiveness at antistatic fabric softening in the subsequent drying process.

Quaternary ammonium compounds are fairly expensive. It has been necessary to add larger amounts of quaternary ammonium compounds to detergents than desired in order to avoid total inactivation in wash solution. Encapsulation of the quaternary ammonium compounds, while preventing inactivation in wash solution, often interferes with the antistatic, fabric-softening effectiveness of the quaternary ammonium compounds in subsequent machine drying. The quaternary ammonium antistatic agents also have a tendency to segregate out in a granular detergent admix because of disparities in particle size.

Several methods have been used to incorporate mixtures of quaternary ammonium compounds and organic dispersion inhibitors into detergent compositions. These methods include prilling, i.e. forming the quaternary antistat and dispersion inhibitor into a prill and then admixing said prill with base detergent granules. The prills may be admixed individually, or may be agglomerated together with any of the well-known various agglomerating agents, and then admixed into conventional detergent compositions. Any of the prilling or processing techniques disclosed in U.S. Pat. No. 3,936,537 to Baskerville and Schiro, have been employed to incorporate these antistatic fabric-softening compositions into conventional detergent granules.

There are several problems with incorporating the intimate mixtures of quaternary ammonium compounds and organic dispersion inhibitor in detergent compositions which these prior incorporation techniques do not solve. If prills are incorporated or admixed individually, segregation from the basic composition can result, with concomitant variation in and loss of fabric-softening capabilities. Coating intimate mixtures of quaternary ammonium compound and organic dispersion inhibitor onto base detergent granules, tarnishes those granules with an unattractive, dull, yellow color. Since these intimate mixtures are relatively insoluble in water, coating inhibits base detergent granules from going into solution, and concomitantly increases the amount of insolubles found in wash water solutions.

Agglomerating prills together to increase effective particle size may result in increasing amounts of insolubles in wash water solutions, an undesirable result. The friability, or crumbling nature of these agglomerates is relatively high, and results in needless waste of valuable quaternary ammonium product. In addition, the agglomerating process itself is an extra step in preparing detergent compositions which can desirably be eliminated.

It is an object of the present invention to provide a particulate additive to laundry detergent compositions to reduce the tendency of fabrics washed with such detergent compositions to generate or retain static electricity when subjected to a subsequent machine drying process.

It is also an object of the present invention to provide detergent compositions incorporating discrete particulates which contain antistat materials capable of reducing the buildup of static charge on fabrics washed with such detergent compositions and subsequently subjected to machine drying.

It is another object of the present invention to provide a detergent composition capable of concurrently laundering, softening, and imparting antistatic benefits to fabrics washed therewith and subsequently machine dried.

It is a further object of the present invention to provide compositions containing certain clay fabric-softening agents and quaternary ammonium antistatic agents which are adapted for use in the washing cycle of a laundering operation.

It is a still further object of the present invention to provide a particulate antistatic fabric-softening composition which will retain its effectiveness of softening fabrics laundered therewith in a subsequent machine drying process.

It is yet a further object of the present invention to provide for maximum antistatic fabric-softening effectiveness by using a minimum amount of antistatic fabric-softening agent in a detergent composition.

It is even a further object of the present invention to provide for a strong, free-flowing, quaternary ammonium antistatic agent to be incorporated into detergent compositions, which can impart effective antistatic, fabric-softening benefits to fabrics laundered therewith in subsequent machine drying.

It is still another object of the present invention to provide an antistatic, fabric-softening detergent additive which can be directly added to a granular detergent composition.

It is yet an even further object of the present invention to provide an antistatic, fabric-softening detergent additive which will remain homogeneously admixed in a conventional detergent composition.

It is also another object of the present invention to reduce the friability of antistatic compositions when incorporated in conventional detergent compositions.

It is yet another object of the present invention to reduce the tendency of antistatic compositions to segregate when incorporated into conventional detergent compositions.

It is even another object of the present invention to reduce the formation of insolubles when detergent compositions are added to wash water solutions.

It is even yet another object of the present invention to facilitate the processing, handling, and preparation of detergent compositions.

It is still another object of the present invention to provide for a single discrete detergent granule comprising antistatic compound, surfactant, detergency builder, and any other conventional detergent additives.

It is still yet a further object of the present invention to eliminate unnecessary processing steps in preparing detergent compositions.

It is still yet another object of the present invention to eliminate waste by providing for maximum antistatic, fabric-softening capabilities in detergency compositions using a minimum amount of antistatic additive.

It is still even a further object of the present invention to provide detergent and fabric-softening compositions which are pleasant and attractive in appearance.

Brief Summary of the Invention

The present invention encompasses a composition for conditioning fabrics comprising (a) from about 3% to about 40% by weight of an intimate mixture of (i) from about 80% to about 20% by weight of the mixture of a quaternary ammonium compound of formula $[R_1R_2R_3R_4N]^+Y^-$ wherein at least one but not more than two of $R_1$, $R_2$, $R_3$, and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxyalkyl, and $C_3$–$C_8$ cyclic structures in which the nitrogen atom or atoms form part of the ring, Y constituting an anionic radical selected from the group consisting of hydroxide, halide, sulfate, methylsulfate, ethylsulfate and phosphate ions, and (ii) from about 20% to about 80% by weight of a dispersion inhibitor, being a solid organic material having a solubility in water of 50 ppm maximum at 25° C. and a softening point in the range of 100° F. to 200° F., said material being selected from the group consisting of paraffinic waxes, cyclic and acyclic mono- and polyhydric alcohols, substituted and unsubstituted aliphatic carboxylic acids, esters of the foregoing alcohols and acids, $C_3$–$C_4$ alkylene oxide condensates of any of the foregoing materials and mixtures thereof, substantially all of said intimate mixture having a solubility in water of about 50 ppm maximum at 25° C. and having a softening point of about 100° F. to about 200° F., said mixture being in the form of generally spherical particles having diameters between about 10 microns and about 500 microns, partially embedded in and attached to, (b) from about 97% to about 60% by weight of spray-dried granules comprising (i) from about 99% to about 5% by weight of surfactant selected from the group consisting of anionic, nonionic, zwitterionic surfactants, and mixtures thereof, and (ii) from about 1% to about 95% by weight of a mixture of (1) from about 1% to about 100% by weight of a detergency builder, and (2) up to about 99% by weight of an inert inorganic water-soluble salt.

The present invention also encompasses a process for preparing a detergent product for conditioning fabrics comprising the steps of (a) mixing intimately (i) from about 80% to about 20% by weight of a quaternary ammonium compound of formula $[R_1R_2R_3R_4N]^+Y^-$ wherein at least one but not more than two of $R_1$, $R_2$, $R_3$, and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxyalkyl, and $C_3$–$C_8$ cyclic structures in which the nitrogen atom or atoms form part of the ring, Y constituting an anionic radical selected from the group consisting of hydroxide, halide, sulfate, methylsulfate, ethylsulfate and phosphate ions, and (ii) from about 20% to about 80% by weight of a dispersion inhibitor, being a solid organic material having a solubility in water of 50 ppm maximum at 25° C. and a softening point in the range of 100° F. to 200° F., said material being selected from the group consisting of paraffinic waxes, cyclic and acyclic mono- and polyhydric alcohols, substituted and unsubstituted aliphatic carboxylic acids, esters of the foregoing alcohols and acids, $C_3$–$C_4$ alkylene oxide condensates of any of the foregoing materials and mixtures thereof, substantially all of said intimate mixture having a solubility in water of about 50 ppm maximum at 25° C. and having a softening point of about 100° F. to about 200° F., (b) spraying said intimate mixture in a molten state at a temperature of from about 160° F. to about 250° F. and a pressure of from about 10 psi to about 100 psi through a spray nozzle, and if said spray nozzle is a two-fluid atomizer nozzle, the second fluid is air at a temperature of from about 180° F. to about 270° F. and a pressure of from about 20 psi to about 150 psi, forming generally spherical particles from about 10 microns to about 500 microns in size, partially embedding in and attaching to spray-dried granules at a temperature of from about 50° F. to about 160° F. at a distance of from about 6 inches to about 75 inches from said nozzle, so that the intimate mixture of the quaternary ammonium compound and the organic dispersion inhibitor comprises from about 3% to about 40% by weight, and the spray-dried granules comprise from about 97% to about 60% by weight, of the composition formed by the attachment, said spray-dried granules comprising (i) from about 99% to about 5% by weight of surfactant selected from the group consisting of anionic, nonionic, amphalytic, and zwitterionic surfactants, and mixtures thereof, and (ii) from about 1% to about 95% by weight of a mixture of (1) from about 1% to about 100% by weight of a detergency builder, and (2) up to about 99% by weight of an inert inorganic water-soluble salt.

DESCRIPTION OF THE DRAWINGS

While the specification concludes with claims particularly pointing out and distinctly claiming the subject matter which is regarded as forming the present invention, it is believed that invention will be better understood from the following detailed description when taken in conjunction with the annexed drawing which describes, discloses, illustrates and shows a preferred embodiment or modification of the present invention and what is presently considered and believed to be the best mode of practicing the principles thereof and wherein:

DETAILED DESCRIPTION OF THE INVENTION

Figure 1:
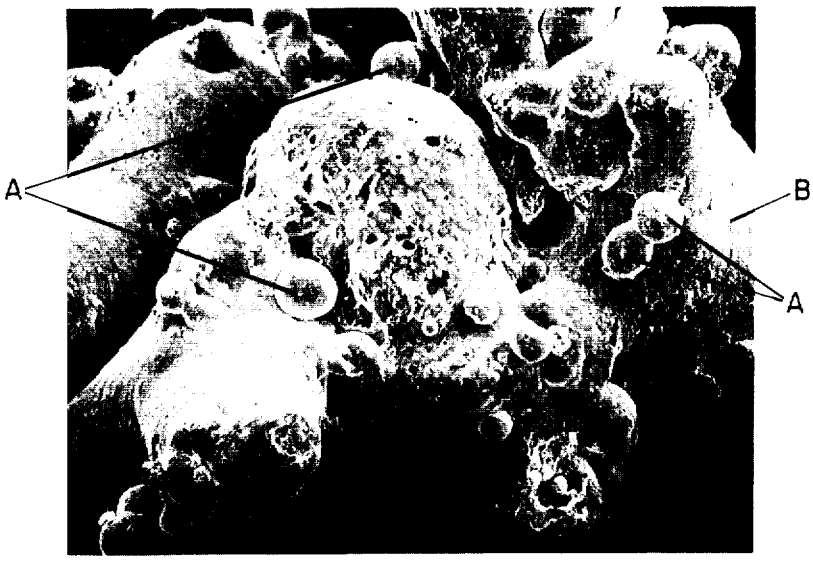
FIG. 1 is a view of spherical particles of intimate mixture of quaternary ammonium compound and organic dispersion inhibitor A, which are partially embedded in and attached to a base spray-dried detergent granule, B.

The spray-on mixture of this invention contains two essential ingredients; the quaternary ammonium antistatic agent; and the organic dispersion inhibitor. The base detergent compositions of the invention comprise a water-soluble detergency compound or surfactant, a detergency builder salt, and an inert inorganic water-soluble additive. The quaternary ammonium compound provides antistatic effects on the fabrics and adds an increment of softening benefit to the fabrics while the detergent and builder components provide the known cleansing and building effects. The various components of the compositions herein are described in greater detail hereinafter, together with the methods of spraying the mixture of quaternary ammonium compound and organic dispersion inhibitor onto the base detergent granules. "Generally spherical particles", as used herein, is understood to include particles of a generally elliptical nature.

The detergent compositions herein provide a solution pH of from about 7 to about 12, preferably from about 9 to about 11, when dissolved in water at a concentration of about 0.12% by weight.

Antistatic Agent

The quaternary ammonium antistatic agent will normally be employed in an amount of from about 80% to about 20%, preferably from about 80% to about 60%, and most preferably from about 80% to about 70% by weight of the intimate mixture with organic dispersion inhibitor. The additive or detergent composition of the invention is employed in providing an aqueous laundering bath or liquor, and normally contains the intimate mixture in an amount sufficient to provide a concentration of quaternary ammonium compound in the bath or liquor of from about 5 ppm (parts per million) to about 250 ppm.

The antistatic agents useful herein are quaternary ammonium salts of the formula $[R_1R_2R_3R_4N]^+Y^-$ wherein $R_1$ and preferably $R_2$ represent an organic radical containing a group selected from a $C_{16}$–$C_{22}$ aliphatic radical or an alkyl phenyl or alkyl benzyl radical having 10–16 atoms in the alkyl chain, $R_3$ and $R_4$ represent hydrocarbyl groups containing from 1 to about 4 carbon atoms, or $C_2$–$C_4$ hydroxy alkyl groups and $C_3$–$C_8$ cyclic structures in which the nitrogen atom or atoms form part of the ring, and Y is an anion such as halide or methylsulfate.

In the context of the above definition, the hydrophobic moiety (i.e., the $C_{16-22}$ aliphatic, $C_{10-16}$ alkyl phenyl or alkyl benzyl radical) in the organic radical $R_1$ may be directly attached to the quaternary nitrogen atom or may be indirectly attached thereto through an amide, ester, alkoxy, ether, or like grouping.

The quaternary ammonium antistatic compounds useful herein include both water soluble and substantially water insoluble materials. For example, the imidazolinium compounds of the structure

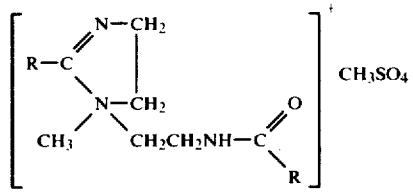

where R is a $C_{16}$–$C_{20}$ alkyl group, possess appreciable water solubility but can be utilized in the present invention by mixture with the appropriate level and type of organic dispersion inhibitor so as to give an ultimate particle solubility in water of less than 50 ppm at 25° C.

Similarly other relatively water-soluble quaternary ammonium antistatic agents can be used such as the diisostearyl dimethyl ammonium chlorides disclosed in U.S. Pat. No. 3,395,100 to Fisher et al.

However, the preferred quaternary ammonium antistatic agents useful herein are characterized by their limited solubility in water. That is to say, such quaternary salts are essentially insoluble in water, existing therein in what appears to be the mesomorphic liquid crystalline state.

The quaternary ammonium antistatic agents used in this invention can be prepared in various ways well known in the art. Many such materials are commercially available. The quaternaries are often made from alkyl halide mixtures corresponding to the mixed alkyl chain lengths in fatty acids. For example, the "di-tallow" quaternaries are made from alkyl halides having mixed $C_{14}$–$C_{18}$ chain lengths. Such mixed di-long chain quaternaries are useful herein and are preferred from a cost standpoint.

As noted above, essentially any anionic group can be the counter-ion in the quaternary compounds used herein. The anionic groups in the quaternary compounds can be exchanged, one for another, using standard anion exchange resins. Thus, quaternary ammonium salts having any desired anion are readily available. While the nature of such anions has no effect on the compositions and processes of this invention, chloride ion is the preferred counter-ion from an availability standpoint.

The following are representative examples of substantially water-insoluble quaternary ammonium antistatic agents suitable for use in the compositions and processes of the instant invention. All of the quaternary ammonium compounds listed can be formulated with the detergent compositions herein, but the compilation of suitable quaternary compounds hereinafter is only by way of example and is not intended to be limiting of such compounds. Dioctadecyldimethylammonium chloride is an especially preferred quaternary antistatic agent for use herein by virtue of its high antistatic activity; ditallow dimethyl ammonium chloride is equally preferred because of its ready availability and its good antistatic activity; other useful di-long chain quaternary compounds are dicetyldimethylammonium chloride; bis-docosyldimethylammonium chloride; didodecyldimethylammonium chloride; ditallowdimethylammonium bromide; dioleoyldimethylammonium hydroxide; ditallowdiethylammorium chloride; ditallowdipropylammonium bromide; ditallowdibutylammonium fluoride, cetyldecylmethylethylammonium chloride, bis-[ditallowdimethylammonium]sulfate; tris-[ditallowdimethylammonium]phosphate; and the like.

Suitable examples of quarternary ammonium antistatic compounds are contained in U.S. Pat. No. 3,936,537, Baskerville and Schiro, incorporated herein by reference.

Organic Dispersion Inhibitor

The essential organic dispersion inhibitor comprises about 20% to about 80%, preferably from about 20% to about 40%, and most preferably 20% to about 30% by weight of the intimate mixture with quaternary ammonium compound.

The dispersion inhibitor should have a solubility in water of 50 ppm max at 25° C. and a softening point in the range of 100° F.-200° F., preferably 125° F.-200° F., and is selected from the group consisting of paraffinic waxes, cyclic and acyclic mono- and polyhydric alcohols, substituted and unsubstituted aliphatic carboxylic acids, esters of the foregoing alcohols and acids, $C_3$-$C_4$ alkylene oxide condensates of any of the foregoing materials and mixtures thereof.

Preferred herein because of ready availability is tallow alcohol, but useful dispersion inhibitors include other fatty alcohols in the $C_{14}$-$C_{26}$ range such as myristyl alcohol, cetyl alcohol, stearyl alcohol, arachidyl alcohol, behenyl alcohol, and mixtures thereof.

Saturated fatty acids having 12 to 24 carbon atoms in the alkyl chain can be used such as: lauric acid, myristic acid, palmitic acid, stearic acid, arachidic acid, and behenic acid, as well as mixtures of these, particularly those derived from naturally occurring sources such as tallow, coconut, and marine oils.

Esters of the aliphatic alcohols and fatty acids are useful dispersion inhibitors, provided they have a total of more than 22 carbon atoms in the acid and alkyl radicals.

Long chain $C_{22}$-$C_{30}$ paraffinic hydrocarbon materials such as the saturated hydrocarbon octacosane having 28 carbon atoms can also be used.

Another preferred class of materials useful in the present invention are the water insoluble sorbitan esters which comprise the reaction product of $C_{12}$-$C_{26}$ fatty acyl halides or fatty acids and the complex mixtures of cyclic anhydrides of sorbitol collectively known as "sorbitan". The reaction sequence necessary to produce such sorbitan esters from sorbitol is set out schematically below, the esters being shown in the fully esterified form.

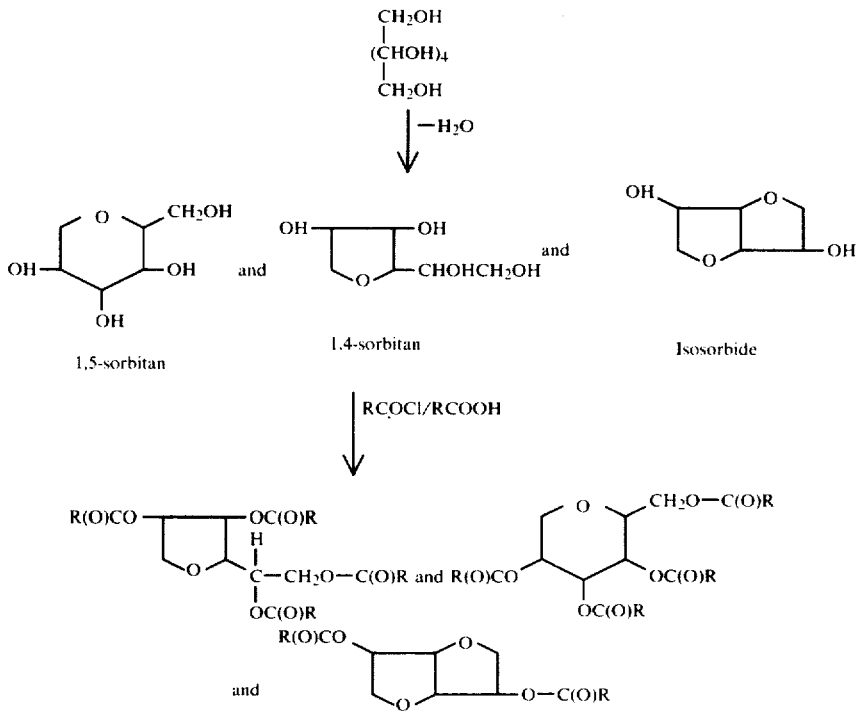

The sorbitan esters are, in turn, complex mixtures of mono, di, tri, and tetra ester forms, of which the tri and tetra are the least water-soluble and hence the most preferred for the purposes of the present invention. However, commercially available mixtures of the various forms are quite satisfactory provided that the mixture satisfies the water solubility and melting point range constraints for the organic dispersion inhibitor. Typical fatty acids that are suitable for the alkyl portion of the ester are palmitic, stearic, docosanoic, and behenic acids and mixtures of any of these. These sorbitan esters, particularly the tri and tetra esters, provide a degree of fabric softening in addition to their function as dispersion inhibitors. Minor proportions of unsaturated $C_{10}$–$C_{26}$ fatty acids, present in commercially available fatty acid mixtures such as coconut-, palm-, tallow-, and marine oil-derived acids are also acceptable. Another preferred group of materials are the $C_{20}$–$C_{26}$ mono- and di- ester forms which also provide a degree of fabric softening performance in addition to their function as dispersion inhibitors.

Materials of this general class are commercially available under various trade names, e.g. the Span® series sold by Atlas Chemical Corporation. Suitable examples of organic dispersion inhibitors are contained in U.S. Pat. No. 3,936,537, Baskerville and Schiro, incorporated herein by reference.

Detergent Compositions

The intimate mixture of quaternary antistat and organic dispersion inhibitor of the present invention is sprayed onto granules of detergent compositions of different types, e.g., additive products intended to provide specific performance attributes where added to wash liquors containing conventional detergent formulations or fully developed formulations designed to include the intimate mixture additive as part of the product.

Examples of the first type include granules containing materials such as oxygen or chlorine bleaches, peroxy bleach activators, optical brighteners, enzymatic agents, detergent builders, and sequestering agents, antibacterial agents, fabric softeners, and the like.

Examples of the second type are those compositions comprising surfactants, detergent builders, suds modifiers, antiredeposition agents, bleaches, etc., which constitute complete heavy-duty laundry products.

Surfactant

From about 99% to about 5% by weight, preferably from about 15% to about 75% by weight of the spray-dried granules can comprise an organic surfactant selected from the group consisting of anionic, nonionic, ampholytic, and zwitterionic detergents and mixtures thereof. Examples of organic surfactants of these types are described in U.S. Pat. No. 3,579,454 (Collier), incorporated herein by reference, column 11, line 45 to column 13, line 64.

Water-soluble salts of the higher fatty acids, i.e., "soaps" are useful as the anionic surfactant herein. This class of surfactants includes ordinary alkali metal soaps such as the sodium, potassium, ammonium, and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Another class of anionic surfactants includes water-soluble salts, particularly the alkali metal, ammonium and alkanolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups). Examples of this group of synthetic surfactants which can be used in the present invention are the sodium and potassium alkyl sulfates, especially those obtained by sulfating the higher alcohols ($C_8$–$C_{18}$ carbon atoms) produced by reducing the glycerides of tallow or coconut oil; sodium or potassium $C_8$–$C_{20}$ paraffin sulfonates; and sodium and potassium alkyl benzene sulfonates, in which the alkyl group contains from about 9 to about 15 carbon atoms in straight chain or branched chain configuration, e.g., those of the type described in U.S. Pat. Nos. 2,220,099 and 2,477,383, incorporated herein by reference (especially valuable are linear straight chain alkyl benzene sulfonates in which the average of the alkyl groups is about 11.8 carbon atoms and commonly abbreviated as $C_{11.8}$ LAS).

Other preferred detergents for use herein are alkyl ether sulfates. These materials have the formula $RO(C_2H_4O)_xSO_3M$ wherein R is alkyl or alkenyl of about 10 to about 20 carbon atoms, x is 1 to 30, and M is a water-soluble cation such as alkali metal, ammonium, and substituted ammonium. The alkyl ether sulfates useful in the present invention are condensation products of ethylene oxide and monohydric alcohols having about 10 to about 20 carbon atoms. Preferably, R has 14 to 18 carbon atoms. The alcohols can be derived from fats, e.g., coconut oil or tallow, or can be synthetic. Lauryl alcohol and straight chain alcohols derived from tallow are preferred herein. Such alcohols are reacted with 1 to 30, and especially 1 to 6, molar proportions of ethylene oxide and the resulting mixture of molecular species, having, for example, an average of 3 moles of ethylene oxide per mole of alcohol, is sulfated and neutralized.

Specific examples of fat-derived alkyl ether sulfates of the present invention are sodium coconut alkyl ethylene glycol ether sulfate; sodium tallow alkyl trioxyethylene ether sulfate; and sodium tallow alkyl hexaoxyethylene sulfate.

Examples of alkyl ether sulfates of synthetic origin in which the starting alcohol is a narrow-cut olefin feed stock include sodium $C_{14-15}$ alkyl trioxyethylene ether sulfate and $C_{15-16}$ alkyl trioxyethylene ether sulfate.

Other anionic surfactant compounds herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain from about 8 to about 13 carbon atoms.

Other useful anionic surfactants herein include the water-soluble salts of esters of $\alpha$-sulfonated fatty acids containing from about 6 to 20 carbon atoms in the ester group; water-soluble salts of 2-acryloxy-alkane-1-sulfonic acids containing from about 2 to 9 carbon atoms in the acyl group and from about 9 to about 23 carbon atoms in the alkane moiety; alkene sulfonates containing from about 10 to 20 carbon atoms in the alkane group; and $\beta$-alkyloxy alkane sulfonates containing from about 1 to 3 carbon atoms in the alkyl group and from about 8 to 20 carbon atoms in the alkane moiety.

Other preferred detergents utilizable herein are olefin sulfonates having about 12 to about 24 carbon atoms. The term "olefin sulfonates" is used herein to mean compounds which can be produced by the sulfonation of $\alpha$-olefins by means of uncomplexed sulfur trioxide, followed by neutralization of the acid reaction mixture in conditions such that any sultones which have been formed in the reaction are hydrolyzed to give the corresponding hydroxy-alkane sulfonates. The sulfur trioxide can be liquid or gaseous, and is usually, but not necessarily, diluted by inert diluents, for example by liquid $SO_2$, chlorinated hydrocarbons, etc., when used in the liquid form, or by air, nitrogen, gaseous $SO_2$, etc., when used in the gaseous form.

The α-olefins from which the olefin sulfonates are derived are mono-olefins having 12 to 24 carbon atoms, preferably 14 to 16 carbon atoms. Preferably they are straight chain olefins. Examples of suitable 1-olefins include 1-dodecane, 1-tetradecene, 1-hexadecene, 1-octadecene, 1-eicosene, and 1-tetracosene.

In addition to the true alkane sulfonates and a portion of hydroxy-alkane sulfonates, the olefin sulfonates can contain minor amounts of other materials, such as alkene disulfonates depending upon the reaction conditions, proportion of reactants, the nature of the starting olefins and impurities in the olefin stock and side reactions during the sulfonation process.

A specific anionic detergent which is useful in the present invention is described more fully in the U.S. Pat. No. 3,332,880 of Phillip F. Pflaumer and Adrian Kessler, issued July 25, 1967, titled "Detergent Composition", the disclosure of which is incorporated herein by reference.

Preferred nonionic surfactants useful in the present invention are those obtained by the condensation of one to twelve ethylene oxide moieties with a $C_{10}$–$C_{18}$ aliphatic alcohol. The alcohol may be completely linear as occurs in materials derived from natural feedstocks such as vegetable oils and animals fats, or may be slightly branched as occurs in petroleum-derived alcohols made by oxo-type synthesis. Particularly preferred materials are $C_{14}$–$C_{15}$ alcohol condensed with an average of seven ethylene oxide groups, $C_{12}$–$C_{13}$ alcohol condensed with an average of about four ethylene oxide groups and then subjected to stripping to remove unethoxylated and low ethoxylated materials, to leave an ethoxylate having a mean of 4.5 ethylene oxide groups.

Preferred zwitterionic materials are derivatives of quaternary ammonium compounds containing an aliphatic straight chain group of 14–18 carbon atoms and a sulfate or sulfonate anionic solubilizing group. Specific examples include 3-(N,N-dimethyl-N-hexadecyl ammonio-2-hydroxypropane-1-sulfonate; 3-(N,N-dimethyl-N-tallowyl ammonio)-2-hydroxypropane-1-sulfonate; 3-(N,N-dimethyl-N-tetradecyl ammonio)propane-1-sulfonate; and 6-(N,N-dimethyl-N-hexadecylammonio)hexanoate.

Suitable examples of surfactants are contained in U.S. Pat. No. 3,936,537, Baskerville and Schiro, incorporated herein by reference.

Detergency Builders and Inert Inorganic Salts

The spray-dried granules of the instant invention contain a mixture of detergent builders and inert inorganic water-soluble salts in an amount from about 1% to about 95% by weight, preferably from about 25% to about 85% by weight. This mixture itself may comprise from about 1% to about 100% (preferably from about 10% to about 99%) by weight of a detergency builder and up to about 99% (preferably from about 1% to about 90%) by weight of an inert inorganic water-soluble salt. Useful builders herein include any of the conventional inorganic and organic water-soluble builder salts as well as various water-insoluble and so-called "seeded" builders. In the present compositions these water-soluble builder salts serve to maintain the pH of the laundry solution in the range of from about 7 to about 12, preferably from about 8 to about 11. Furthermore, these builder salts enhance the fabric cleaning performance of the overall compositions while at the same time they serve to suspend particulate soil released from the surface of the fabrics and prevent its redeposition on the fabric surfaces. Additionally, in preferred detergent compositions that contain certain smectite clays as fabric softening agents, polyanionic builder salts have been found to cause these smectite-type clays to be readily and homogeneously dispersed throughout the aqueous laundering medium with a minimum of agitation. The homogeneity of the clay dispersion is necessary for the clay to function effectively as a fabric softener, while the ready dispersability allows granular detergent compositions to be formulated.

Suitable detergent builder salts useful herein can be of the polyvalent inorganic and polyvalent organic types, or mixtures thereof. Non-limiting examples of suitable water-insoluble, inorganic alkaline detergent builder salts include the alkali metal carbonates, borates, phosphates, polyphosphates, tripolyphosphates, bicarbonates, and silicates. Specific examples of such salts include the sodium and potassium tetraborates, bicarbonates, carbonates, tripolyphosphates, pyrophosphates, and hexametaphosphates.

Examples of suitable organic alkaline detergency builder salts are: (1) water-soluble amino polyacetates, e.g., sodium and potassium ethylenediaminetetraacetates, nitrilotriacetates, and N-(2-hydroxyethyl)nitrilodiacetates; (2) water-soluble salts of phytic acid, e.g., sodium and potassium phytates; (3) water-soluble polyphosphonates, including, sodium, potassium and lithium salts of ethane-1-hydroxy-1,1-diphosphonic acid; sodium, potassium, and lithium salts of methylenediphosphonic acid and the like.

Additional organic builder salts useful herein include the polycarboxylate materials described in U.S. Pat. No. 2,264,103, including the water-soluble alkali metal salts of metllitic acid. The water-soluble salts of polycarboxylate polymers and copolymers such as are described in U.S. Pat. No. 3,308,067, incorporated herein by reference, are also suitable herein. It is to be understood that while the alkali metal salts of the foregoing inorganic and organic polyvalent anionic builder salts are preferred for use herein from an economic standpoint, the ammonium, akanolammonium, e.g., triethanolammonium, diethanolammonium, and the like, water-soluble salts of any of the foregoing builder anions are useful herein.

Mixtures of organic and/or inorganic builders can be used herein. One such mixture of builders is disclosed in Canadian Pat. No. 755,038, e.g., a ternary mixture of sodium tripolyphosphate, trisodium nitrilotriacetate, and trisodium ethane-1-hydroxy-1,1-diphosphonate.

A further class of builder salts is the insoluble alumino silicate type which functions by cation exchange to remove polyvalent mineral hardness and heavy metal ions from solution. A preferred builder of this type has the formulation $Na_z(AlO_2)_z(SiO_2)_y.x\ H_2O$ wherein z and y are integers of at least 6, the molar ratio of z to y is in the range from 1.0 to about 0.5 and x is an integer from about 15 to about 264. Compositions incorporating builder salts of this type form the subject of the commonly assigned Application of John Michael Corkill, Bryan L. Madison, and Michael E. Burns, Ser. No. 450,266 filed Mar. 11, 1974 and entitled "Detergent", the disclosure of which is incorporated herein by reference.

Another type of detergency builder material useful in the present compositions and processes comprises a water-soluble material capable of forming a water-insoluble reaction product with water hardness cations in combination with a crystallization seed which is capable of providing growth sites for said reaction product. Such "seeded builder" compositions are fully disclosed in the copending application of Benjamin, Ser. No. 248,546, filed Apr. 28, 1972, now abandoned, the disclosures of which are incorporated herein by reference.

More particularly, the seeded builders useful herein comprise a crystallization seed having a maximum particle dimension of less than 20 microns, preferably a particle diameter of from about 0.01 micron to about 1 micron, in combination with a material capable of forming a water-insoluble reaction product with free metal ions.

Many builder materials, e.g., the water-soluble carbonate salts, precipitate water hardness cations, thereby performing a builder function. Unfortunately, many of the precipitating builders used in laundry compositions do not reduce the free metal ion content of laundry baths quickly, and such builders only compete with the organic detergent and the soil for the free metal ions. The result is that while some of the free metal ions are removed from the solution, some ions do react with the organic detergent and the soil, thereby decreasing the detersive action. The use of the crystallization seed quickens the rate of precipitation of the metal cations, thereby removing the hardness before it can adversely affect detergency performance.

By using a material capable of forming a water-insoluble product with free metal ions in combination with a crystallization seed, the combined ($Ca^{++}$ and $Mg^{++}$) free metal ion concentration of an aqueous laundering liquor can be reduced to less than 0.5 grains of hardness within about 120 seconds. In fact, the preferred seeded builders can reduce the free metal hardness to less than 0.1 grains/gallon within about 30 seconds.

Preferred seeded builders consist of: a water-soluble material capable of forming a reaction product having a solubility in water of less than about $1.4\times10^{-2}$ wt.% (at 25° C.) with divalent and polyvalent metal ions such as calcium, magnesium and iron; and a crystallization seed (0.001-20 micron diameter) which comprises a material which will not completely dissolve in water within 120 seconds at 25° C.

Specific examples of materials capable of forming the water-insoluble reaction product include the water-soluble salts of carbonates, bicarbonates, sesquicarbonates, silicates, aluminates and oxalates. The alkali metal, especially sodium, salts of the foregoing materials are preferred for convenience and economy.

The crystallization seed employed in such seeded builders is preferably selected from the group consisting of calcium carbonate; calcium and magnesium oxalates; barium sulfate; calcium, magnesium and aluminum silicates; calcium and magnesium oxides; calcium and magnesium salts of fatty acids having 12 to 22 carbon atoms; calcium and magnesium hydroxides; calcium fluoride; and barium carbonate. Specific examples of such seeded builder mixtures comprise: 3:1 wt. mixtures of sodium carbonate and calcium carbonate having a 5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron; and a 3:3:1 wt. mixture of sodium carbonate, sodium aluminate and calcium oxide having a particle diameter of 5 microns.

A seeded builder comprising a mixture of sodium carbonate and calcium carbonate is especially preferred herein. A highly preferred seeded builder comprises a 30:1 to 5:1 (wt. $Na_2CO_3$:$CaCO_3$) mixture of sodium carbonate and calcium carbonate wherein the calcium carbonate has an average particle diameter from 0.01 micron to 5 microns.

Another type of builder useful herein includes various substantially water-insoluble materials which are capable of reducing the hardness content of laundering liquors, e.g., by ion-exchange processes. Examples of such builder materials include the phosphorylated cloths disclosed in U.S. Pat. No. 3,424,545 to Bauman issued Jan. 28, 1969, incorporated herein by reference.

Inert inorganic water-soluble salts which are included in the above mixtures include any of the well-known alkali metal halide salts, and alkali metal sulfates such as sodium sulfate or potassium sulfate. Suitable examples of detergency builders and inert inorganic salts are contained in U.S. Pat. No. 3,936,537, Baskerville and Schiro, incorporated herein by reference.

Clay Compounds

A valuable optional ingredient of the present compositions consists of particular smectite clay materials, namely sodium and calcium montmorillonites, sodium saponites, and sodium hectorites. These smectite clays can be present in compositions of this invention at levels from about 5% to about 90% by weight, preferably from about 8% to about 75% by weight. In the built detergent composition embodiments of this invention, the smectite clay is used in an amount from about 1% to about 50%, preferably from about 5% to about 25% by weight. The clays used herein are "impalpable", i.e., have a particle size which cannot be perceived tactilely. Impalpable clays have particle sizes below about 50 microns; the clays used herein have a particle size range of from about 5 microns to about 50 microns.

The clay minerals can be described as expandable, three-layer clays, i.e., alumino-silicates and magnesium silicates, having an ion exchange capacity of at least 50 meq/100 g. of clay and preferably at least 60 meq/100 g. of clay. The term "expandable" as used to describe clays relates to the ability of the layered clay structure to be swollen, or expanded, on contact with water. The three-layer expandable clays used herein are those materials classified geologically as smectites.

There are two distinct classes of smectite clays that can be broadly differentiated on the basis of the numbers of octahedral metal-oxygen arrangements in the central layer for a given number of silicon-oxygen atoms in the outer layers. The dioctahedral minerals are primarily trivalent metal ion-based clays and are comprised of the prototype pyrophyllite and the members montmorillonite $(OH)_4Si_{8-y}Al_y(Al_{4-x}Mg_x)O_{20}$, nontronite $(OH)_4Si_{8-y}Al_y(Al_{4-x}Fe_x)O_{20}$, and volchonskoite $(OH)_4Si_{8-y}Al_y(Al_{4-x}Cr_x)O_{20}$, where x has a value of from 0 to about 4.0 and y has a value of from 0 to about 2.0. Of these only montmorillonites having exchange capacities greater than 50 meq/100 g. are suitable for the present invention and provide fabric softening benefits.

The trioctahedral minerals are primarily divalent metal ion based and comprise the prototype talc and the members hectorite $(OH)_4Si_{8-y}Al_y(Mg_{6-x}Li_x)O_{20}$, saponite $(OH)_4(Si_{8-y}Al_y)(Mg_{6-x}Al_x)O_{20}$, sauconite $(OH)_4Si_8$.

$_yAl_y(Zn_{6-x}Al_x)O_{20}$, vermiculite $(OH)_4Si_{8-y}Al_y(Mg_{6-x}Fe_x)O_{20}$, wherein y has a value of 0 to about 2.0 and x has a value of 0 to about 6.0. Hectorite and saponite are the only minerals in this class that are of value in the present invention, the fabric softening performance being related to the type of exchangeable cation as well as to the exchange capacity. It is to be recognized that the range of the water of hydration in the above formulas can vary with the processing to which the clay has been subjected. This is immaterial to the use of the smectite clays in the present invention in that the expandable characteristics of the hydrated clays are dictated by the silicate lattice structure.

As noted hereinabove, the clays employed in the compositions of the instant invention contain cationic counterions such as protons, sodium ions, potassium ions, calcium ions, and lithium ions. It is customary to distinguish between clays on the basis of one cation predominantly or exclusively absorbed. For example, a sodium clay is one in which the absorbed cation is predominantly sodium. Such absorbed cations can become involved in exchange reactions with cations present in aqueous solutions. A typical exchange reaction involving a smectite-type clay is expressed by the following equation:

$$\text{smectite clay } (Na)^+ + NH_4OH \rightleftharpoons \text{smectite clay } (NH_4) + NaOH$$

Since the foregoing equilibrium reaction, one equivalent weight of ammonium ion replaces an equivalent weight of sodium, it is customary to measure cation exchange capacity (sometimes termed "base exchange capacity") in terms of milli-equivalents per 100 g. of clay (meq/100 g.). The cation exchange capacity of clays can be measured in several ways, including by electrodialysis, by exchange with ammonium ion followed by titration or by a methylene blue procedure, all as fully set forth in Grimshaw, "The Chemistry and Physics of Clays", pp. 264–265, Interscience (1971). The cation exchange capacity of a clay mineral relates to such factors as the expandable properties of the clay, the charge of the clay, which, in turn, is determined at least in part by the lattice structure, and the like. The ion exchange capacity of clays varies widely in the range from about 2 meq/100 g. of kaolinites to about 150 meq/100 g., and greater, for certain smectite clays. Illite clays although having a three layer structure, are of a non-expanding lattice type and have an ion exchange capacity somewhere in the lower portion of the range, i.e., around 26 meq/100 g. for an average illite clay. Attapulgites, another class of clay minerals, have a spicular (i.e. needle-like) crystalline form with a low cation exchange capacity (25–30 meq/100 g.). Their structure is composed of chains of silica tetrahedrons linked together by octahedral groups of oxygens and hydroxyls containing Al and Mg atoms.

It has been determined that illite, attapulgite, and kaolinite clays, with their relatively low ion exchange capacities, are not useful in the instant compositions. Indeed, illite and kaolinite clays constitute a major component of clay soils and, as noted above, are removed from fabric surfaces by means of the instant compositions. However the alkali metal montmorillonites, saponites, and hectorites, and certain alkaline earth metal varieties of these minerals such as calcium montmorillonites have been found to show useful fabric softening benefits when incorporated in compositions in accordance with the present invention.

Specific non-limiting examples of such fabric softening smectite clay minerals are:

| |
|---|
| Sodium Montmorillonite |
| Brock |
| Volclay BC |
| Gelwhite GP |
| Thixo-Jel #1 |
| Ben-A-Gel |
| Sodium Hectorite |
| Veegum F |
| Laponite SP |
| Sodium Saponite |
| Barasym NAS 100 |
| Calcium Montmorillonite |
| Soft Clark |
| Gelwhite L |
| Imvite |
| Lithium Hectorite |
| Barasym LIH 200 |

Accordingly, smectite clays useful herein can be characterized as montmorillonite, hectorite, and saponite clay minerals having an ion exchange capacity of at least about 50 meq/100 g. and preferably at least about 60 meq/100 g.

While not intending to be limited by theory, it appears that the advantageous softening (and potentially dye scavenging, etc.) benefits of the instant compositions are ascribable to the physical characteristics and ion exchange properties of the clay minerals used therein. Furthermore, the unique physical and electrochemical properties of the smectite clays apparently cause their interaction with, and dispersion by, the polyanionic builder salts used in the instant compositions. Thus, it has now been found that, rather than agglomerating to form viscous gels when contacted by water, the smectite clays used herein can be added to aqueous laundry baths in granular compositions containing polyanionic detergency builders of the type disclosed herein to yield homogeneous, clay suspensions. The problems of gelling and agglomeration usually encountered when smectite clays are added to aqueous media in solid form are alleviated by the presence of the builder. Apparently, the negative electrical charges on the builder anions serve to repulse the clay particles, thereby providing the desired homogeneous clay dispersion and preventing agglomeration. Whatever the reason for the advantageous co-action of the detergency builder and smectite clays used herein, the combination of polyanionic detergency builderss with the specific aluminum-containing and magnesium-containing smectites, provides a means whereby such smectite clay minerals can be added in solid form to surfactant-containing media so as to give the homogeneous clay dispersion required for effective fabric softening performance.

Most of the smectite clays useful in the compositions herein are commercially available under various tradenames, for example, Thixo-Jel #1 and Gelwhite GP from Georgia Kaolin Co., Elizabeth, N.J.; Volclay BC and Volclay #325, from American Colloid Co., Skokie, Ill.; and Veegum F, from R. T. Vanderbilt. It is to be recognized that such smectite minerals obtained under the foregoing tradenames can comprise mixtures of the various discrete mineral entities. Such mixtures of the smectite minerals are suitable for use herein.

Within the classes of montmorillonite, hectorite, and saponite clay minerals having a cation exchange capacity of at least about 50 meq/100 g, certain clays are preferred for fabric softening purposes. For example, Gelwhite GP is an extremely white form of smectite clay and is therefore preferred when formulating white granular detergent compositions. Volclay BC, which is a smectite clay mineral containing at least 3% of iron (expressed as $Fe_2O_3$) in the crystal lattice, and which has a very high ion exchange capacity, is one of the most efficient and effective clays for use in laundry compositions and is preferred from the standpoint of product performance. On the other hand, certain smectite clays marketed under the name "bentonite" are sufficiently contaminated by other silicate minerals, as evidenced by a low colloid content ($\approx$50%) that their ion exchange capacity falls below the requisite range, and such clays are of no use in the instant compositions.

Bentonite, in fact, is a rock type originating from volcanic ash and contains montmorillonite (one of the smectite clays) as its principal clay component. The Table shows that materials commercially available under the name bentonite can have a wide range of cation exchange capacities and fabric softening performance.

| Bentonite | Supplier | Exchange Capacity meq/100 g | Softening Ability |
|---|---|---|---|
| Brock | Georgia Kaolin Co. USA | 63 | Good |
| Soft Clark | Georgia Kaolin Co. USA | 84 | Good |
| Bentolite L | Georgia Kaolin Co. USA | 68 | Fair - Good |
| Clarolite T-60 | Georgia Kaolin Co. USA | 61 | Fair |
| Granulare Naturale Bianco | Seven C. Milan Italy | 23 | Fair - Poor |
| Thio-Jel #4 | Georgia Kaolin Co. USA | 55 | Poor* |
| Granular Naturale Normale | Seven C. Milan Italy | 19 | Poor |
| Clarsol FB 5 | Ceca Paris France | 12 | Poor |
| PDL 1740 | Georgia Kaolin Co. USA | 26 | None |
| Versuchs Product FFI | Sud-Chemie Munich Germany | 26 | None |

*Low colloid content ($\approx$ 50%)

Appropriate clay minerals for use herein can be selected by virtue of the fact that smectites exhibit a true 14 Å x-ray diffraction pattern. This characteristic pattern, taken in combination with exchange capacity measurements performed in the manner noted above, provides a basis for selecting particular smectite-type minerals for use in the compositions disclosed herein.

The smectite clay materials useful in the present invention are hydrophilic in nature, i.e. they display swelling characteristics in aqueous media. Conversely they do not swell in nonaqueous or predominantly nonaqueous systems, including those incorporating the smectite clay minerals described hereinbefore should restrict the nonionic content of the surfactant system to less than 33% by weight of the total surfactant, preferably less than 25%.

Suitable examples of clay compounds are contained in U.S. Pat. No. 3,936,537, Baskerville and Schiro, incorporated herein by reference.

Other Optional Components

Optional components include color speckles which may be admixed with the spray-dried base detergent granules. These color speckles may comprise a mixture of sodium tripolyphosphate, dextrin glue solution, and minor components. The color speckles may also comprise spray-dried anionic detergent granules agglomerated with dyed polyethylene glycol, such as PEG 6000 (molecular weight), or other suitable agglomerating agents. Color speckles may be present in compositions of this invention at levels from about 1% to 50% by weight, preferably from about 1% to about 25% by weight, and most preferably from about 1% to about 15% by weight. Additionally, a small amount of alkyl polyethoxylate, such as coconut alcohol polyethoxylate ($EO_{6.0}$) may be included in these compositions, i.e. from about 0.1% to about 1.0% by weight of the final detergent composition.

Another optional ingredient that may be incorporated is an enzyme for removal of protein-based or carbohydrate-based stains. Enzymes for removing protein-based stains are proteolytic in nature such as those sold under the trade names "Alcalase" and "Esterase" by Novo Industries A/S Denmark or under the trade names "Maxatase" and "AZ Protease" by Gist-Brocades N.V. The Netherlands. These materials are normally incorporated at levels of up to 1% by weight, preferably 0.25% to 0.75% by weight, and are preferably coated or prilled with inert additives to minimize dust formation and improve storage stability. A wide range of enzyme materials and means for their incorporation into synthetic detergent granules is disclosed in U.S. Pat. No. 3,553,139 issued on Jan. 5, 1971, to McCarty, Roald, DeOude, Blomeyer, and Cracco which disclosure is hereby incorporated by reference.

A further ingredient that may be incorporated to improve product performance is a bleaching agent of the halogen or oxygen-containing type. Examples of the hypohalite bleach type include trichloro isocyanuric acid and the sodium and potassium dichloroisocyanurates and N-chloro and N-bromo alkane sulphonamides. Such materials are normally added at 0.5%–10% by weight of the finished product, preferably 1%–5% by weight.

Examples of oxygen-containing bleaches include sodium perborate, sodium percarbonate, and potassium monopersulphate that are incorporated at levels of 5–30%, preferably 10–25% by weight of the final product. The inclusion of organic bleach activators such as phthalic anhydride, tetra acetyl ethylene diamine, tetra acetyl methylene diamine or tetra acetyl glycouril lead to the in situ production during the washing process of the corresponding organic peroxy acids which have enhanced low temperature bleaching performance. Activators of this type are normally used with sodium perborate, at usage levels of 5–15% by weight of the final product.

Materials to boost or modify the sudsing pattern of the compositions of the present invention may also be included. Examples of suds boosters include coconut and tallow mono- and di-alkanolamides, particularly ethanolamides and $C_{12-15}$ alkyl di-lower alkyl amine oxides. Typical suds depressors include long chain fatty acids such as those disclosed in U.S. Pat. No. 2,954,347 issued Sept. 27, 1960, to Wayne St. John and combinations of certain nonionics therewith as disclosed in U.S. Pat. No. 2,954,348 issued Sept. 27, 1960, to Eugene Schwoeppe, both disclosures being incorporated herein by reference.

Other optional ingredients in granular products include hydrotropes and anticaking additives such as salts of lower alkaryl sulphonic acids, salts of α-sulphosuccinic acid, and α-sulphobenzoic acid, and urea, normally utilized at levels of 0.5% to 5% by weight of the final product, preferably at levels of 1%-3% by weight. $C_{12}$-$C_{18}$ alkyl acid phosphates and their condensation products with ethylene oxide may also be incorporated at similar levels for contro[1] of crutcher mix viscosity. Antiredeposition agents such as carboxymethyl cellulose, hydroxyethyl cellulose, and their derivatives may also be incorporated.

Advantageously, ingredients may also be included to minimize the wrinkling of fabrics that occurs during conventional drying processes. Detergent products incorporating starch and other particulate materials useful as fabric conditioning agents are disclosed in U.S. Pat. No. 3,892,681 issued July 1, 1975, and incorporated herein by reference. A non-limiting example of such a fabric conditioning agent is corn starch, which can be added at a level of 0.1-5.0% by weight of the composition, preferably 0.25-1.0%.

Anti-tarnish and anti-corrosion agents, perfume and colour may also be included, the last ingredient being conveniently added either as a general colour or in the form of a speckle applied to a separate granule fraction of the entire formulation or to a granulate of one or more of the ingredients. Brightener and fluorescent lighting agents may also be included.

The pH of detergent formulations in accordance with the present invention can lie anywhere within the range 5-12 but is preferably chosen to fall within the range 8.0-10.5 as this provides a slight particulate soil removal benefit on synthetic fabrics. However, the use of specific optional components such as enzymes may require the selection of a product pH that will permit optimum functioning of the component concerned.

Suitable examples of other optional detergent additives are contained in U.S. Pat. No. 3,936,537, Baskerville and Schiro, incorporated herein by reference.

Composition Usage

Levels of product addition to give from about 10 ppm to about 250 ppm, preferably from about 40 ppm to about 100 ppm of antistatic agent in solution are generally used. Where the additive forms part of a combination product providing, for example, presoak capability the formulation will typically comprise about 1% to about 30%, preferably 5% to 20% by weight of the attached particulate antistat intimate mixture, from about 1% to about 25%, preferably from about 10% to about 20% of a detergent surfactant, from about 10% to about 80%, preferably from about 20% to about 60% of a detergency builder, from about 5% to about 45%, preferably from about 10% to about 30% by weight of a bleach, and from about 0.05% to about 2.0%, preferably from about 0.1% to about 1.0% by weight of a detergency enzyme. Compositions of this type are designed to deliver approximately 100-500 ppm builder concentration to a 5-8 gallon soak solution when employed at the ½ to 1½ cup usage level which is common practice in household laundering processes.

Fully formulated detergent compositions, in addition to providing the solution concentration of detergency builder specified above, provide a surfactant concentration in the range 50-500 ppm, more preferably 150-250 ppm in a 5-8 gallon wash solution. Surfactant level in product will normally range from 1% to 50%, preferably 10% to 25% by weight of the composition.

In use, the detergent additive product may be in contact with the fabrics for 1 to 24 hours if employed as, or as part of, a presoak treatment following which the wash liquor is removed and replaced by fresh water and detergent, and the fabrics are laundered.

When used directly in the laundering operation either as a separate additive product or as part of a fully formulated detergent composition, the solution containing the suspended particulate antistat additive is in contact with the fabrics for 10 to 45 minutes, following which, the fabrics are rinsed and spun dry before being subjected to temperatures of 125° F.-200° F. in a conventional rotary dryer. During the drying process, the particulate antistat product softens as the fabrics approach the dryer air temperature, and the tumbling action of the dryer causes the individual particles of material to "crayon" or smear, thus distributing the quaternary antistat over the surface of the fabrics and minimizing the build-up of static charges on the fabrics.

Method of Preparation

Compositions are prepared by spraying a molten mixture of quaternary ammonium compound and organic dispersion inhibitor onto spray-dried base detergent granules comprising surfactant, detergency builders, and any other optional ingredients. This preparation eliminates prilling and agglomerating used in preparing current compositions.

Initially an intimate mixture of quaternary ammonium compound and organic dispersion inhibitor is prepared. This mixture is then sprayed in a molten state through a spray nozzle onto spray-dried detergent base granules in a mixing drum. Any of the spray nozzles known in the art are suitable for the spraying, including single-fluid nozzles and two-fluid nozzles. Preferred are two-fluid nozzles in which air is the second fluid and where the air temperature is from about 180° F. to about 270° F., preferably from about 200° F. to about 260° F., and most preferably from about 200° F. to about 250° F., and the air pressure is from about 20 psi to about 150 psi, preferably from about 40 psi to about 120 psi, and most preferably from about 80 psi to about 110 psi. The molten intimate mixture may be obtained by melting a dry mix addition of the two materials or by intimately mixing the materials in their molten states. This molten mixture is at a temperature from about 160° F. to about 250° F., preferably from about 180° F. to about 240° F., and most preferably from about 200° F. to about 220° F. when sprayed. The molten mixture is sprayed at a pressure from about 10 psi to about 100 psi, preferably from about 15 psi to about 75 psi, and most preferably from about 20 psi to about 50 psi.

In a two-fluid atomizer spray nozzle, the warm air and the molten mixture of quaternary ammonium compound and organic dispersion inhibitor flow into the spray nozzle separately until both streams exit at the nozzle orifice through different openings. A suitable atomizer spray nozzle is manufactured by Spraying Systems Co., air cap #122281-60, liquid cap #40100. However, preferred is a concentric pipe two-fluid atomizer which consists of an inner pipe carrying the molten mixture within and completely surrounded by a larger diameter pipe carrying the warm air. The air and the liquid flow separately into the same nozzle orifice. The air flows into the nozzle orifice through several openings arranged around one larger opening through which the liquid passes into the nozzle orifice. Multiple nozzle-orifice blocks can be used either in a straight line or in a staggered arrangement, with the distance between the blocks approximately equal to 12 inches. The nozzle blocks are welded to the inner (liquid) pipe and the outer (air) pipe to hold the structure together and to create a pressurized air chamber for atomization. The advantages of the concentric pipes two-fluid atomizer include greater efficiency and convenience of use because of its compactness, ease of mounting, and ease in variation of the spray angle and spray distance. This atomizer also eliminates the need for any separate heat tracing and insulation of the liquid line because the warm air functions as the atomizing agent, the insulator and the heat tracer maintaining the temperature of the molten mixture, and thus results in energy and materials savings. Finally, the concentric pipe two-fluid atomizer significantly reduces nozzle clogging and down time, further demonstrating the usefulness of this particular atomizer.

Once outside the nozzle orifice, the stream of air breaks up the molten stream of quaternary ammonium compound and organic dispersion inhibitor into microscopic spherical particles. Generally spherical particles, as used herein, are understood to include particles of a general elliptical nature. These spherical particles begin to freeze before hitting the base granules falling in front of the atomizer nozzle in the mixing drum. The mixing drum is an almost horizontally mounted, cylindrical, revolving drum with baffles mounted along the axis of the drum to carry the base granules up toward a vertical position where the granules fall to the bottom of the drum passing through the path of the spray. Most of the granules fall from the baffles into the spray, but some are carried to higher positions where they fall from the baffles onto a protective hood covering the spray nozzle, and then off the front end of the hood in a curtain directly into the path of the spray. The hood functions to prevent any of the granules from being sprayed at a distance too close to the spray nozzle to permit the molten spherical particles to partially solidify before striking the granules, and thus prevents coating of the granules. The hood also protects the spray nozzles from fouling by preventing spray granules from contacting the nozzles. It can be appreciated that the spray distance can be regulated by altering the positioning of the spray nozzle and the protective hood, by varying the length of the hood and the size of the mixing drum, by varying the angular velocity of the mixing drum, and by varying the spray pressures involved. The mixing drum diameter can range from about 1 foot to about 8 feet, but a diameter of 4 feet is preferred and the drum is revolving at about 24 revolutions per minute. The base granules pass in front of the nozzle orifice at a distance from about 6 inches to about 72 inches, preferably from about 6 inches to about 30 inches, more preferably from about 8 inches to about 20 inches, and most preferably from about 10 inches to about 15 inches. The temperature of the base detergent granules is from about 50° F. to about 160° F., preferably from about 70° F. to about 140° F., and most preferably from about 80° F. to about 120° F., in order to get proper attachment of the ammonium compound/dispersion inhibitor mixture on the base granule surface.

The microscopic spherical particles will be partially frozen on hitting and penetrating the base granule surfaces. When partially between molten and frozen states, the spherical particles will hit the base granule surface and attach as distinct particles which are substantially spherical and are not deformed although they impact with sufficient force to partially embed in the detergent granule, yielding optimum characteristics.

The spherical particles will be from about 10 microns (u) to about 500 microns in size, preferably from about 25 microns to about 250 microns in size, and most preferably from about 50 microns to about 200 microns in size, i.e. have diameters in those size ranges. The intimate mixture of quaternary ammonium compound and organic dispersion inhibitor will have a softening point between about 100° F. and about 200° F., preferably between about 150° F. and about 175° F., and a solubility in water of about 50 ppm maximum at 25° C.

Figure 2:
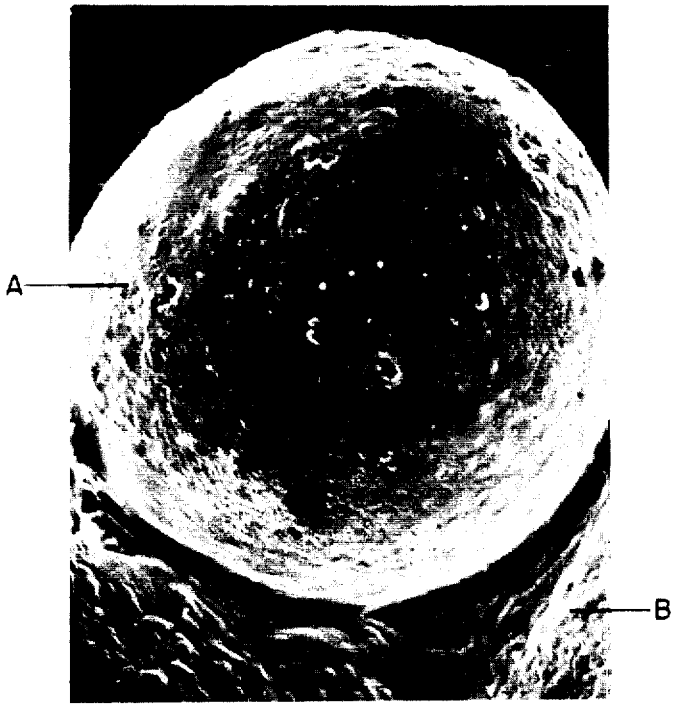
FIG. 2 is a close-up view of a spherical particle of intimate mixture of quaternary ammonium compound and organic dispersion inhibitor A, which is partially embedded in and attached to a base spray-dried detergent granule, B.

FIGS. 1 and 2 are views of compositions which have been produced by this process. Referring specifically to FIG. 1, spherical particles of quaternary ammonium compound and organic dispersion inhibitor, A, are partially embedded in and attached to a base detergent granule, B. FIG. 2 is a close up view where a spherical particle of quaternary ammonium compound and organic dispersion inhibitor has been partially embedded in and attached to a base detergent granule, B.

The spherical particles must be partially frozen on hitting the base granule surfaces. If the spherical particles are completely frozen, they will bounce off the base granule surfaces; if the spherical particles are completely molten, "wetting" will occur along the base granule surfaces, with the spherical particles losing their distinct character. "Wetting" results in base detergent granules coated with an insoluble layer of quaternary ammonium compound and organic dispersion inhibitor mixture, making the granule less soluble. This coating on the base detergent granule tarnishes the base detergent granule with an unattractive, dull, yellow color. Coating is to be avoided.

It is surprising that the structure is stable. The spherical particles adhere with sufficient strength to avoid being knocked off despite the relatively small area of contact, despite the fact that they stick out from the surface of the spray dried granule, and despite the fact that no "glue" is used to improve adherence. The result is a substantially uniform product which does not segregate, allows the detergent to dissolve readily and maintains the integrity of the softener particles in the wash water.

The weight percent of intimate mixture of quaternary ammonium compound and organic dispersion inhibitor in the two-component system of spray-dried granules and quaternary ammonium compound-organic dispersion inhibitor intimate mixture is from about 3% to about 40% by weight, preferably from about 3% to about 30% by weight, and most preferably from about 5% to about 25% by weight. The weight percent of spray-dried granules in this particular two-component system is from about 97% to about 60% by weight, preferably from about 97% to about 70% by weight, and most preferably from about 95% to about 75% by weight. The spray-dried base granules may optionally be made to incorporate smectite clay, color speckles, sodium tripolyphosphate (as in U.S. patent application Ser. No. 816,761, McDanald, filed july 18, 1977, incorporated herein by reference), detergency builders, bleaching agents and bleach activators, suds boosters or suds suppressors, anti-tarnish and anti-corrosion agents, soil suspending agents, soil release agents, dyes, fillers, optical brighteners, germicides, pH adjusting agents, alkalinity sources, hydrotropes, enzymes, enzyme-stabilizing agents, perfumes, alkyl polyethoxylate nonionic surfactants, and other optional detergency components, prior to the spraying of the quaternary ammonium compound-organic dispersion inhibitor mixture. These optional components may also be incorporated into the compositions of the present invention after the spraying process is completed.

The following examples illustrate the compositions and processes of the invention but are not intended to be limiting thereof:

EXAMPLE I

A mixture of 5 parts ditallowdimethylammonium chloride (DTDMAC), 1.75 parts tallow alcohol (TA), and 0.25 miscellaneous ingredients and water is melted to a temperature from about 210°-230° F. This molten mixture of DTDMAC/TA is fed through a two-fluid atomizer nozzle where it is sprayed at a pressure from about 15 psi to about 75 psi, along with air at a temperature from about 200° F. to about 240° F. and a pressure from about 40 psi to about 80 psi, onto base detergent granules in a mixing drum. The base detergent granules are passing in front of the atomizer nozzle orifice at a distance of from about 18 inches to about 20 inches, at a temperature of about 125° F.

Once outside the spray nozzle orifice, the air breaks up the molten mixture of DTDMAC/TA into spherical particles which are partially frozen on contacting the base detergent granules, where they form separate, distinct generally spherical particles partially embedded in and attached to the base granule surfaces.

The base detergent granules are then admixed with clay, speckles, and sprayed with perfume and coconut alcohol polyethoxylate ($EO_{6.0}$). The composition produced is as follows:

| | | Parts |
|---|---|---|
| Base Detergent Granule | | |
| Sodium ($C_{12}$) linear alkyl benzene sulfonate | | 12.0 |
| Sodium ($C_{14-16}$) alkyl ethoxy$_{1.0}$ sulfate | | 6.0 |
| Sodium silicate (2.0 ratio) | | 12.0 |
| Tallow fatty acid | | 0.5 |
| Sodium tripolyphosphate | | 20.7 |
| Brightener | | 0.29 |
| Sodium sulfate | | 23.31 |
| Moisture | | 4.8 |
| TOTAL for base detergent granule | | 79.6 |
| Admix | | |
| Perfume | | 0.15 |
| Coconut alcohol polyethoxylate$_{6.0}$ | | 0.25 |
| Sodium montmorillonite clay (ion exchange capacity about 63 meq/100 g. commercially available from Georgia Kaolin Co., USA, under the trade name BROCK) | | 8.00 |
| Speckles | | |
| Sodium tripolyphosphate | 3.7 | |
| Moisture, dextrin glue, and minor components | 1.3 | |
| | | 5.00 |
| Spray-On Mixture | | |
| Ditallowdimethyl ammonium chloride | 5.00 | |
| Tallow alcohol | 1.75 | |
| Miscellaneous and water | 0.25 | |
| | | 7.00 |
| | TOTAL | 100.00 |

Comparable results are obtained when ditallowdimethyl ammonium chloride is substituted or mixed with ditallowdimethyl ammonium methyl sulfate, ditallowdimethyl ammonium ethyl sulfate, 1-methyl-1-[(tallowamido)ethyl]-2-tallowimidazolinium methyl sulfate. Comparable results are obtained when the alkyl benzene sulfonate is substituted or mixed with sodium tallow alkyl sulfate and/or sodium coconut alkyl ethylene glycol ether sulfate.

Comparable results are also obtained when tallow alcohol is substituted or mixed with $C_{10}$-$C_{22}$ acyl sorbitan ester, e.g., sorbitan trilaurate, sorbitan trimyristate, sorbitan tripalmitate, sorbitan tristearate, sorbitan tetralaurate, sorbitan tetramyristate, sorbitan tetrapalmitate, sorbitan tetrastearate, and mixtures thereof. Other examples of organic dispersion inhibitors which will perform equally well are lauric acid, myristic acid, palmitic acid, stearic acid, arachidic acid, behenic acid, myristyl alcohol, cetyl alcohol, stearyl alcohol, arachidyl alcohol, behenyl alcohol, saturated ($C_{28}$) octacosane, paraffin wax (melting point about 130° F., commercially available from Boren Laboratories, Cleveland, Ohio, under the trade name Parowax), alkyl ($C_6$) myristate, alkyl ($C_{12}$) laurate, alkyl ($C_6$) myristylate, alkyl ($C_{12}$) stearylate, the condensate of alkylene ($C_3$) oxide and lauric acid, the condensate of alkylene ($C_4$) oxide and cetyl alcohol, and mixtures thereof.

Comparable results are obtained when a 1.6 sodium silicate ratio is used.

Comparable results are obtained when base detergent granules are passing in front of the atomizer nozzle orifice at a distance of from about 10 inches to about 12 inches, and/or the atomizer spray nozzle is manufactured by Spraying Systems Co., air cap #122281-60, liquid cap #40100, or is a concentric pipe two-fluid atomizing nozzle, or when the two fluid atomizer nozzle is substituted with a single-fluid hydraulic nozzle.

Comparable results are also obtained when the base detergent granules are admixed with the clay and the speckles prior to the spraying of the spray-on mixture.

EXAMPLE II

A mixture of 5 parts ditallowdimethyl ammonium chloride (DTDMAC), 1.75 parts tallow alcohol (TA), and 0.25 miscellaneous ingredients and water is melted to a temperature of from about 210°-230° F. This molten mixture of DTDMAC/TA is fed through a two-fluid atomizer nozzle where it is sprayed at a pressure from about 15 psi to about 75 psi, along with air at a temperature from about 200° F. to 240° F. and a pressure from about 40 psi to about 80 psi onto base detergent granules in a mixing drum. The base detergent granules are passing in front of the atomizer nozzle orifice at a distance from about 18 inches to about 20 inches, at a temperature of about 125° F.

Once outside tne spray nozzle orifice, the air breaks up the molten mixture of DTDMAC/TA into spherical particles which are partially frozen on contacting the base detergent granules, where they form separate, distinct generally spherical particles partially embedded in the base granule surfaces.

The base detergent granules are then admixed with clay and speckles and sprayed with perfume. The composition formed is as follows:

| | | Parts |
|---|---|---|
| Base Detergent Granule | | |
| Sodium ($C_{12}$) linear alkyl benzene sulfonate | | 12.0 |
| Sodium ($C_{14-16}$) alkyl ethoxy$_{1.0}$ sulfate | | 6.0 |
| Sodium silicate (2.0 ratio) | | 12.0 |
| Sodium aluminosilicate (hydrated Zeolite A, particle diameter 1-10μ) | | 20.0 |
| Tallow fatty acid | | 0.5 |
| Sodium sulfosuccinate | | 2.0 |
| Brightener | | 0.29 |
| Sodium sulfate | | 21.66 |
| Moisture | | 7.4 |
| TOTAL base detergent granule | | 81.85 |
| Perfume | | 0.15 |
| Speckles (spray-dried anionic detergent granules agglomerated with dyed polyethylene glycol 6000) | | 3.00 |
| Sodium montmorillonite clay (ion exchange capacity about 63 meq/100 g, commercially available from Georgia Kaolin Co., USA, under the trade name BROCK) | | 8.00 |
| Spray-On Mixture | | |
| Ditallowdimethyl ammonium chloride | 5.00 | |
| Tallow alcohol | 1.75 | |
| Miscellaneous and water | 0.25 | |
| | | 7.00 |
| TOTAL | | 100.00 |

Comparable results are obtained when ditallowdimethyl ammonium chloride is either substituted by, or mixed with, ditallowdimethyl ammonium methyl sulfate, ditallowdimethyl ammonium ethyl sulfate, 1-methyl-1-[(tallowamido)ethyl]-2-tallowimidazolinium methyl sulfate, and mixtures thereof. Comparable results are obtained when the alkyl benzene sulfonate is substituted or mixed with sodium tallow alkyl sulfate and/or sodium coconut alkyl ethylene glycol ether sulfate.

Comparable results are also obtained when tallow alcohol is either substituted by, or mixed with $C_{10}$–$C_{22}$ acyl sorbitan ester, e.g., sorbitan trilaurate, sorbitan trimyristate, sorbitan tripalmitate, sorbitan tristearate, sorbitan tetralaurate, sorbitan tetramyristate, sorbitan tetrapalmitate, sorbitan tetrastearate, and mixtures thereof. Other examples of organic dispersion inhibitors which will perform equally well are lauric acid, myristic acid, palmitic acid, stearic acid, arachidic acid, behenic acid, myristyl alcohol, cetyl alcohol, stearyl alcohol, arachidyl alcohol, behenyl alcohol, saturated ($C_{28}$) octacosane, paraffin wax (melting point about 130° F., commercially available from Boren Laboratories, Cleveland, Ohio, under the trade name Parowax), alkyl ($C_6$) myristate, alkyl ($C_{12}$) laurate, alkyl ($C_6$) myristylate, alkyl ($C_{12}$) stearylate, the condensate of alkylene ($C_3$) oxide and lauric acid, the condensate of alkylene ($C_4$) oxide and cetyl alcohol, and mixtures thereof.

Comparable results are obtained when base detergent granules are passing in front of the atomizer nozzle orifice at a distance of from about 10 inches to about 12 inches.

Comparable results are obtained when the two-fluid atomizer nozzle is substituted with a single-fluid hydraulic nozzle.

Comparable results are also obtained when the base detergent granules are admixed with the clay and the speckles prior to the spraying of the spray-on mixture.

EXAMPLE III

A granular spray-on detergent composition was prepared according to the procedure outlined in Example I. The composition produced was as follows:

| | | Parts | |
|---|---|---|---|
| Base Detergent Granule | | | |
| Sodium $C_{12}$ linear alkyl benzene sulfonate | | 12.0 | |
| Sodium $C_{14-16}$ alkyl ethoxy$_{1.0}$ sulfate | | 6.0 | |
| 2.0 ratio sodium silicate | | 12.0 | |
| Sodium tripolyphosphate | | 16.7 | |
| Sodium sulfate total (crutched) | | 14.3 | (1.3) |
| Tallow fatty acid | | 0.5 | |
| Coconut alcohol polyethoxylate ($EO_{6.0}$) | | 0.25 | |
| Brightener | | 0.294 | |
| Perfume | | 0.15 | |
| Water | | 4.0 | |
| Miscellaneous (tower gain) | | 0.8 | |
| TOTAL base detergent granule | | 67.0 | |
| Admix | | | |
| Sodium tripolyphosphate (STP) | | 4.0 | |
| Color speckles (sodium tripolyphosphate) | | 5.0 | (3.7) |
| Sodium montmorillonite clay (ion exchange capacity about 63 meq/100 g) | | 12.0 | |
| Spray-On Mixture | | | |
| Ditallowdimethyl ammonium chloride (DTDMAC) | 5.00 | | |
| Tallow alcohol (TA) | 1.75 | | |
| Miscellaneous and water | 0.25 | | |
| TOTAL spray-on mixture | 7.00 | | |
| TOTAL | | 95.0 | |

This compositional breakdown provides the basis for the next four Compositions, A, B, C, and D.

Initially, about seven pounds of DTDMAC-TA mixture was sprayed onto about 67 pounds of base detergent granules. This totaled about 74 pounds of DTDMAC-TA spray-on plus base detergent granules (Composition A). Next, about seven pounds of DTDMAC-TA mixture was sprayed onto about 50 pounds of base detergent granules. This particular composition was then admixed with about 17 pounds of unsprayed base detergent granules, bringing the total of DTDMAC-TA spray-on plus base detergent granules up to about 74 pounds (Composition B). Finally, about seven pounds of DTDMAC-TA mixture was sprayed onto about 30 pounds of base detergent granules. This particular composition was then admixed with about 37 pounds of unsprayed base detergent granules, bringing the total of DTDMAC-TA spray-on plus base detergent granules up to about 74 pounds (Composition C). In all three compositions, A, B, and C, the level of DTDMAC-TA and base detergent granules totalled to about 74 pounds. Compositions A, B, and C were then admixed with about 4.0 pounds of STP, about 5.0 pounds of color speckles, and about 12 pounds of sodium montmorillonite clay to give finished product compositions.

In addition, a control composition was prepared which included DTDMAC-TA prills agglomerated together and admixed with base detergent granules. No granules were sprayed with DTDMAC-TA mixture. The components of the particular detergent composition were as follows:

| | | Parts |
|---|---|---|
| Base Granule | | |
| Sodium $C_{12}$ linear alkylbenzene sulfonate | | 12.0 |
| Sodium fatty alcohol ($C_{14-16}$) polyethylene oxide $EO_{10}$) sulfate | | 6.0 |
| Sodium silicate solids (2.0 ratio) | | 12.0 |
| Sodium tripolyphosphate crutched | | 16.7 |
| Sodium sulfate total (crutched) | | 14.3 (1.3 parts) |
| Tallow fatty acid | | 0.5 |
| Coconut alcohol polyethoxylate ($EO_6$) | | 0.25 |
| Brightener | | 0.294 |
| Water | | 4.0 |
| Miscellaneous (tower gain) | | 0.8 |
| Base detergent granules | | 67.0 |
| Color speckles (STP) | | 5.0 (3.7 parts |
| Subtotal | | 72.0 |
| Admix | | |
| Sodium montmorillonite clay (ion exchange capacity of about 63 meq/100 g. available from Georgia Kaolin Co., USA, under the trade name Brock) | | 12.0 |
| Agglomerate | | |
| Sodium tripolyphosphate | | 4.0 |
| Prill: | | |
| Ditallowdimethyl ammonium chloride (DTDMAC) | 5.0 | |
| Tallow alcohol (TA) | 1.8 | |
| Miscellaneous and water | 0.2 | |
| | 7.0 | 7.0 |
| Glue mix: | | |
| Dextrin | 1.67 | |
| Water | 3.33 | |
| | 5.0 | 5.0 |
| Total additive | | 28.0 |
| TOTAL | | 100.0 |

In producing the control composition, about seven pounds of DTDMAC-TA prills was admixed with about 67 pounds of base detergent granules, bringing the total of DTDMAC-TA prills plus base detergent granules to about 74 pounds. Above five pounds of color speckles and about 12 pounds of clay were then admixed to give the finished product composition of the control.

These four compositions were measured on the Cone Index to determine degree of segregation, and for friability and cake grade. Measurements on the Cone Index were taken with and without the 12 pounds sodium montmorillonite clay (ion exchange capacity of about 63 meq/100 g), admixed with Compositions B and C. Clay was not admixed wih Composition A and 12 pounds of clay was included in the control composition. The results of the Cone Index measurements were as follows (an explanation of Cone or Coning Index measurement is contained in Example VII):

| Cone Index (Degree of Segregation) | | |
|---|---|---|
| Composition | Cone Index With Clay | Cone Index Without Clay |
| A | — | 8.7 |
| B | 14.0 | 10.7 |
| C | 11.3 | 5.8 |

-continued

| Cone Index (Degree of Segregation) | | |
|---|---|---|
| Composition | Cone Index With Clay | Cone Index Without Clay |
| control* | 40.8 | — |

*(contains 7 pounds agglomerated prills of DTDMA-TA:67 pounds base detergent granule)

The results indicate an overall low degree of segregation, and especially favorable results when compared with the control performance. These results are surprising, considering the structure, and indicate the strength of the bond between the DTDMAC-TA particles and the base detergent granule.

Friability measurements were taken for just the sprayed-on base granules of Compositions A, B, and C, and in addition, for base detergent granules alone, without any spray-on, admix agglomerate, or other additives included (Composition D). The composition of these base detergent granules was the same as base detergent granules sprayed with DTDMAC-TA mixture.

To determine the friability, a finite weight of granular detergent compositions is shaken and shifted through 20 mesh, 28 mesh, and 100 mesh Tyler sieves respectively. The weight percent of original sample passing through the 100 mesh Tyler sieve is determined as follows: [(total weight—weight retained on 20-mesh sieve—weight retained on 28 mesh sieve—weight retained on 100 mesh sieve) ÷ total weight] × 100.

The entire sample is then combined and placed in an attrition apparatus where air is allowed to blow through the sample, while all dust, granules, and particles of the sample are contained within. The entire sample is then removed from the attrition apparatus, reweighed, and again sifted through 20 mesh, 28 mesh, and 100 mesh Tyler sieves respectively. The weight percent of sample passing through the 100 mesh Tyler sieve after attrition is calculated in the same manner as for the original sample.

Now the difference between the weight percent of sample passing through the 100 mesh Tyler sieve after attrition, and the weight percent of original sample passing through the 100 mesh Tyler sieve, is the measure of friability of the sample. The larger the difference, the greater the friability. The friability is a measure of the dust generated during agitation, i.e. the tendency of a particular detergent granule to crumble during handling.

Cake grade measurements were taken for Compositions A, B, and C, and for the control composition, all on a finished product basis. To determine cake grade, a sample of detergent composition is compressed under a 20 lb. weight for one minute, forming a "cake". This "cake" sample is then placed under a mechanical force gauge (a suitable gauge is a Heuba Spring mechanical force gauge, manufactured by Ametek), and force is applied to break the cake. The pounds force needed to break a cake of the sample is recorded as a measure of the cake grade of the sample. The larger the amount of pounds-force needed to be applied, the larger the cake grade reading. A relatively low cake grade, i.e., little force needed to break a cake of sample, is indicative of good flow and good storage characteristics of a detergent sample. A relatively high cake grade indicates poor flow and poor storage characteristics of a detergent product.

Friability measurements were not taken for the control composition and cake grade measurements were not taken for Composition D. The results of the friability and cake grade measurements were as follows:

| Composition | Friability | Finished Product Cake Grade |
|---|---|---|
| A | 30.5% | 4.2 |
| B | 25.2% | 4.0 |
| C | 27.9% | 4.6 |
| D (base detergent granules alone) | 29.9% | — |
| control* | — | 4.7 |

*(contains 7 pounds agglomerated prills DTDMAC-TA: 67 pounds base detergent granule)

The results indicate that base detergent granules with spray-on mixture of DTDMAC-TA have at least a comparable degree of friability as base detergent granules without spray-on, which is surprising in view of the structure. If anything, one would have expected greater friability. Measurements also indicate a slightly improved cake grade of the sprayed-on base detergent granules as compared to the control composition. This also is surprising since one would expect the DTDMAC-TA particles to increase caking, if anything.

EXAMPLE IV

About seven pounds of DTDMAC-TA mixture was sprayed onto about 82 pounds of the base detergent granule as disclosed in Example II (Composition A). About seven pounds of DTDMAC-TA mixture was also sprayed onto about 55 pounds of base detergent granule, and further admixed with about 27 pounds of unsprayed base detergent granules, bringing the total of DTDMAC-TA spray-on plus base detergent granules up to about 89 pounds (Composition B). Next, about seven pounds of DTDMAC-TA mixture was sprayed onto about 30 pounds of base detergent granules, and then admixed with about 52 pounds of unsprayed base detergent granules, bringing the total of DTDMAC-TA spray-on plus base detergent granules up to about 89 pounds (Composition C). The compositional breakdown of the base detergent granules and the DTDMAC-TA mixture was identical with Example II for all three compositions, A, B and C. Compositions A, B, and C were then admixed with about 3.0 pounds of color speckles, about 8.0 pounds of sodium montmorillonite clay, and sprayed with about 0.15 pounds of perfume.

In addition, the 82 parts of base detergent granule were also sprayed with 8.4 parts of DTDMAC-TA mixture (6.0 parts DTDMAC, 2.2 parts TA, 0.2 parts miscellaneous and water) to give a composition as follows:

| | | Parts |
|---|---|---|
| Base Detergent Granule | | |
| Sodium ($C_{12}$) linear alkyl benzene sulfonate | | 12.0 |
| Sodium alkyl ($C_{14-16}$) ethoxy ($EO_{1.0}$) sulfate | | 6.0 |
| Sodium silicate (2.0 ratio) | | 12.0 |
| Sodium aluminosilicate (hydrated Zeolite A, particle diameter 1-10$\mu$) | | 20.0 |
| Tallow fatty acid | | 0.5 |
| Sodium sulfosuccinate | | 2.0 |
| Brightener | | 0.29 |
| Sodium sulfate | | 21.66 |
| Moisture | | 7.4 |
| TOTAL base detergent granule | | 81.85 |
| Perfume | | 0.15 |
| Speckles (spray-dried anionic detergent granules agglomerated with dyed polyethylene glycol 6000) | | 3.00 |
| Sodium montmorillonite clay (ion exchange capacity about 63 meq/100 g, commercially available from Georgia Kaolin Co., USA, under the trade name BROCK) | | 8.00 |
| Spray-on Mixture | | |
| Ditallowdimethyl ammonium chloride | 6.00 | |
| Tallow alcohol | 2.20 | |
| Miscellaneous and water | 0.20 | |
| | | 8.40 |
| TOTAL | | 101.40 |

This compositional breakdown provides the basis for the next four compositions, D, E, F, and G. About 8.4 pounds of DTDMAC-TA mixture was sprayed onto about 82 pounds of base detergent granules in this fashion (Composition D). Additionally, about 8.4 pounds of DTDMAC-TA mixture was sprayed onto about 55 pounds of base detergent granules, and then admixed with 27 pounds of unsprayed base detergent granules (Composition E). About 8.4 pounds of DTDMAC-TA mixture was further sprayed onto about 30 pounds of base detergent granules and admixed with about 52 pounds of unsprayed base detergent granules (Composition F). Also, about 8.4 pounds of DTDMAC-TA mixture was sprayed onto about 82 pounds of base detergent granules, and admixed with about one pound of zeosyl 110 (Composition G). Compositions D, E, F, and G were each admixed with about 3.0 pounds of color speckles, about 8.0 pounds of sodium montmorillonite clay, and sprayed with about 0.15 pounds of perfume.

A control composition was prepared comprising prills of DTDMAC-TA agglomerated with sodium sulfate and then admixed with clay and base detergent granules. The composition of the control was approximately as follows:

| | | Parts |
|---|---|---|
| Base Detergent Granule | | |
| Sodium $C_{12}$ linear alkyl benzene sulfonate | | 12.0 |
| Sodium ($C_{14-16}$) alkyl ethoxy$_{1.0}$ sulfate | | 6.0 |
| Sodium sulfosuccinate (hydrated Zeolite A, particle diameter 1-10) | | 2.0 |
| Sodium silicate (2.0 ratio) | | 12.0 |
| Sodium sulfate | | 15.8 |
| Brightener | | 0.29 |
| Tallow fatty acid | | 0.5 |
| Sodium aluminosilicate | | 20.0 |
| Coconut alcohol polyethoxylate ($EO_{6.0}$) | | 0.25 |
| Perfume | | 0.15 |
| TOTAL base detergent granule | | 68.99 |
| Speckles (spray-dried anionic detergent granules agglomerated with dyed polyethylene glycol 6000) | | 3.00 |
| Sodium montmorillonite clay (ion exchange capacity about 63 meq/100 g) | | 8.00 |
| Moisture (water and miscellaneous) | | 4.00 |
| Agglomerate | | |
| Prill | | |
| Ditallowdimethyl ammonium chloride | 6.0 | |

-continued

| | | Parts |
|---|---|---|
| Tallow alcohol | 2.2 | |
| Miscellaneous and water | 0.2 | |
| | | 8.4 |
| Sodium sulfate | | 4.0 |
| Glue Mix | | |
| Dextrin | 1.2 | |
| Water | 2.4 | |
| | | 3.6 |
| TOTAL agglomerate | | 16.0 |
| TOTAL PARTS | | 99.9 |

About 8.4 pounds of DTDMAC-TA prills were agglomerated with about 4.0 pounds of sodium sulfate and about 3.6 pounds of glue mix, and then admixed with about 3.0 pounds of speckles, about 8.0 pounds of sodium montmorillonite clay, and about 69 pounds of base detergent granules to produce the control composition.

The respective compositions were measured for weight percent DTDMAC on a colorimeter. It is not known why the weight percent DTDMAC would differ from sample to sample but it nevertheless differs. A series of fabrics were washed in these respective compositions, including the control composition, under ordinary wash water conditions (about 125° F. for the voltage and static cling runs and about 70° F. for the insolubles grade run) and then dried under ordinary machine drying conditions. The fabrics were then measured for average volts per square yard, number of clings, and insolubles grade. Dew point temperature of the room around the machine dryer was measured in °F. for each test run. Four test runs of the control composition were taken.

After washing, the respective fabrics were graded for insolubles while still wet. Observations of at least two graders were recorded on a scale of one to five (half grades may be used). The garments or fabrics were observed by the graders on the outside, inside, front and back for insolubles. The lower the number, the more insolubles are observed on a particular fabric. Therefore, a higher insolubles grade is indicative of good solubility of a particular detergent composition, while a lower insolubles grade indicates poorer solubility of a particular detergent composition.

The results of these tests under ordinary wash water and machine drying conditions were as follows:

| Composition | Weight Percent DTDMAC Analyzed | Average Volts/Sq. Yd. | Number of Clings | Dew Point in Machine Dryer (°F.) | Insolubles Grade |
|---|---|---|---|---|---|
| A | 5.8% | 1.0 | 0 | 58 | 2.5 |
| B | 5.9% | 1.1 | 0 | 58 | 2.7 |
| C | 5.8% | 1.0 | 1 | 53 | 2.1 |
| D | 4.3% | 3.6 | 5 | 57 | 2.9 |
| E | 4.5% | 1.4 | 1 | 57 | 2.8 |
| F | 5.0% | 0.7 | 0 | 58 | 2.9 |
| G (with one part Zeosyl added) | 6.35% | 1.0 | 0 | 53 | 2.5 |
| the control four runs | 6.2% | 1.85 | 0 | 57 | average insolubles |
| | 6.2% | 1.4 | 0 | 54 | grade of 2.5 |
| (contains 8.4 parts agglomerated prills of DTDMAC-TA:69 parts base detergent granule) | 6.2% | 2.4 | 6 | 52 | over four test |
| | 6.2% | 1.8 | 2 | 52 | runs |

The dew point temperature of the room around the machine dryer will affect static control. At higher dew point temperatures, greater static control will be observed. Test runs of spray-on detergent composition vs. the control may be compared at comparable dew points in the room around the machine dryer. From the results, it can be seen that at comparable dew points, the fabrics washed in the spray-on detergent compositions registered less average voltage and less instances of cling than fabrics washed in the control composition. In fact, except for one particular test run, the spray-on detergent compositions demonstrated overall good static control. The one exception, the Composition D test run, may be explained by the lower level of DTDMAC (4.3% by weight) analyzed in that composition.

When one compares the level of DTDMAC analyzed in the spray-on compositions and the control compositions, it can be seen that the spray-on detergent compositions accomplish a better level of static control with less DTDMAC analyzed. This is surprising, as there seems to be no logical reason for this result. The insolubles grading for fabrics washed in the spray-on compositions was as good, if not better than the average insolubles grade for fabrics washed in the control composition.

EXAMPLE V

The granular detergent composition of Example II (7 parts spray-on mixture DTDMAC-TA: 82 parts base detergent granules) was prepared according to the procedure outlined in Example II by spraying about 7 pounds of DTDMAC-TA mixture onto about 82 pounds of base detergent granules and then admixing with about 3.0 pounds of color speckles, about 8.0 pounds of sodium montmorillonite clay, and spraying with about 0.15 pounds of perfume. Two separate compositions, Composition A and Composition B, were prepared in this manner. In addition, about 7 pounds of DTDMAC-TA mixture was sprayed onto about 55 pounds of base detergent granules, and admixed with about 27 pounds of unsprayed base detergent granules (Composition C). Composition C was admixed with about 8.0 pounds of sodium montmorillonite clay, about 3.0 pounds of speckles, and sprayed with about 0.15 pounds of perfume.

A series of fabrics were washed in three separate wash water solutions of Composition A, and Composition B, and Composition C under ordinary wash water conditions (about 125° F. for the voltage and static cling runs and about 70° F. for the insolubles grade run) and then dried under ordinary machine drying conditions.

The fabrics were then measured for average volts per square yard, number of clings, and insolubles grade as in Example IV. The respective compositions were measured for weight percent DTDMAC on a colorimeter. It is not known why the weight percent DTDMAC differs from sample to sample, but it nevertheless differs. Dew point temperature in °F. was measured in the room surrounding the machine dryer for each test run.

The results of these tests were as follows:

| Composition | Weight Percent DTDMAC Analyzed | Average Volts/ Sq. Yd. | Number of Clings | Dew Point in Machine Dryer (°F.) | Insolubles Grade |
|---|---|---|---|---|---|
| A | 4.7% | 2.1 | 0 | 61 | 3.7 |
| B | 5.8% | 1.1 | 0 | 61 | 3.2 |
| C | 4.4% | 1.9 | 0 | 61 | 3.1 |

These readings, all for a constant dew point, indicate that relatively good antistatic control may be achieved by base granules sprayed with an intimate mixture of ditallowdimethyl ammonium chloride and tallow alcohol. No instances of cling between washed fabrics were noted. The disparity in average volts per square yard reading may be explained as corresponding to the level of DTDMAC measured in each of the compositions. The insolubles grade, on a scale of five, was favorable for all three samples.

EXAMPLE VI

Approximately 8.4 lbs. of an intimate mixture of ditallowdimethyl ammonium chloride (DTDMAC) and tallow alcohol (TA) is melted in a spray tank to a temperature from about 210° F. to about 230° F. The composition of the intimate mixture comprises approximately 6.0 parts DTDMAC, 2.00 parts tallow alcohol, and 0.40 parts miscellaneous and water. The molten DTDMAC-TA mixture is then fed into a spray arm which contains four two-fluid atomizer nozzles at the end of air lines and molten DTDMAC-TA lines. Air at about 55 psi. and about 220° F. to about 250° F. is fed to the spray nozzles in the spray arm.

The spray arm is connected to a mixing drum which contains about 82 lbs. of spray-dried base detergent granules of the following composition:

| Base Detergent Granule | Parts |
|---|---|
| Sodium ($C_{12}$) linear alkyl benzene sulfonate | 12.0 |
| Sodium ($C_{14-16}$) alkyl ethoxy$_{1.0}$ sulfate | 6.0 |
| Sodium silicate (2.0 ratio) | 12.0 |
| Sodium aluminosilicate (hydrated Zeolite A, 1-10μ) | 20.0 |
| Tallow fatty acid | 0.5 |
| Sodium sulfosuccinate | 2.0 |
| Brightener | 0.29 |
| Sodium sulfate | 21.66 |
| Moisture | 7.4 |
| TOTAL base detergent granule | 81.85 |

The mixing drum is approximately 5 ft. by 2½ ft. in diameter with eight three-inch baffles. The mixing drum is revolving at about 10 revolutions per minute (rpm) to provide a continuous curtain of base granules passing in front of the spray nozzles. The base detergent granules' temperature is from about 100° F. to about 110° F.

The molten mixture of DTDMAC-TA is pumped into the spray nozzles inside the mixing drum at 20 psi. pressure where it is atomized into spherical droplets by the air and sprayed onto the base detergent granules. The spray distance from the nozzle orifice to the base detergent granules is from about 8 inches to about 12 inches. Approximately five minutes are required to spray about 8.4 lbs. of molten DTDMAC-TA mixture onto about 82 lbs. of base detergent granules.

The sprayed detergent granules are then unloaded from the mixing drum and screened through a 12 mesh Tyler sieve. Approximately 8.0 parts (or pounds) sodium montmorillonite clay (ion exchange capacity about 63 meq/100 g) and about 3.0 parts (or pounds) speckles (spray-dried anionic detergent granules agglomerated with dyed polyethylene glycol 6000) are admixed, and the resulting admixture sprayed with about 0.15 parts (or pounds) perfume to make a finished product. A small amount (about one part or pound) of 1% zeosyl 110 is optionally added to improve free-flow characteristics. This all totals to about 102.4 parts or pounds.

EXAMPLE VII

The Cone or Coning Index is a measure of segregation of detergent granules. Equipment used to determine the Coning Index includes two funnels or cones, one vertically above the other in the same position, with a distance of about 10 inches between the bottom of the top cone and the top of the bottom cone.

Approximately 100 grams of finished product is mixed thoroughly and poured into the top funnel. The finished product flows down into the lower funnel, and then flows into four separate beakers, each beaker collecting about 25 grams of product. Each of the four samples in the four beakers is then analyzed for percent DTDMAC (by weight).

The Coning Index formula is a fraction, the numerator being the difference between the highest and lowest weight percent DTDMAC analyzed over the four samples, and the denominator being the average weight percent DTDMAC over the four samples taken. This fractional reading is then multiplied by 100 to give the Coning Index.

The detergent composition prepared in Example VI was run through the Coning Index procedure, and four samples taken. The weight percent DTDMAC in each of the four samples was analyzed to be 6.27%, 5.82%, 6.04%, and 6.46% respectively. The average weight percent DTDMAC over these four samples was 6.148% DTDMAC. Applying the formula described above for determining the Coning Index, the calculation is as follows:

$$\frac{(6.46 - 5.82)\,(100)}{(6.148)} \quad 10.4$$

Coning Index for the composition prepared in Example VI

This is compared to a Coning Index of 40.8 for the following composition where DTDMAC-TA prills were agglomerated together and admixed with base detergent granules, but not sprayed onto base detergent granules:

| | Parts |
|---|---|
| Base Granule | |
| Sodium $C_{12}$ linear alkylbenzene sulfonate | 12.0 |
| Sodium fatty alcohol ($C_{14-16}$) polyethylene oxide (poly- | |

-continued

| | | Parts | |
|---|---|---|---|
| ethoxylate $EO_{10}$) sulfate | | 6.0 | |
| Sodium silicate solids (2.0 ratio) | | 12.0 | |
| Sodium tripolyphosphate crutched | | 16.7 | |
| Sodium sulfate total (crutched) | | 14.3 | (1.3 parts) |
| Tallow fatty acid | | 0.5 | |
| Coconut alcohol polyethoxylate ($EO_6$) | | 0.25 | |
| Brightener | | 0.294 | |
| Water | | 4.0 | |
| Miscellaneous (tower gain) | | 0.8 | |
| Base Detergent Granules | | 67.0 | |
| Color speckles (STP) | | 6.0 | parts (3.7 parts) |
| | Subtotal | 72.0 | |
| Admix | | | |
| Sodium montmorillonite clay (ion exchange capacity of about 63 meq/100 g, available from Georgia Kaolin Co., USA, under trade name Brock) | | 12.0 | |
| AGGLOMERATE | | | |
| Sodium tripolyphosphate | | 4.0 | |
| Prill: | | | |
| Ditallowdimethyl ammonium chloride (DTDMAC) | 5.0 | | |
| Tallow alcohol (TA) | 1.8 | | |
| Miscellaneous & water | 0.2 | | |
| | 7.0 | | 7.0 |
| Glue mix: | | | |
| Dextrin | 1.67 | | |
| Water | 3.33 | | |
| | 5.0 | | 5.0 |
| | Total additive | 28.0 | |
| | TOTAL | 100.0 | |

The Cone Index is a measure of the degree of segregation of detergent granules, the higher the Cone Index, the greater the segregation. Therefore, on the basis of this measurement, the composition produced in Example VI has almost one quarter the degree of segregation that the conventional detergent composition has, where prills of DTDMAC-TA are agglomerated and admixed together with base detergent granules. This is surprising, since the agglomerates approximate the size and density of the base granules.

EXAMPLE VIII

The composition disclosed in Example II was prepared according to the method disclosed in Example II, except that the base granule temperature was about 180° F. at the time of the spraying of intimate DTDMAC-TA mixture onto the base granules. The composition disclosed in Example I was also prepared according to the procedure outlined in Example I, with base granules at temperatures of about 80° F. and about 125° F. respectively, when sprayed with intimate DTDMAC-TA mixture. The base detergent granules of Example II and Example I were then compared for spray-on characteristics. It should be noted that actual chemical composition of the base detergent granules do not affect the spray-on characteristics observed herein.

The base detergent granules sprayed at 180° F. were observed to be completely coated around the base granule surfaces by intimate DTDMAC-TA mixture. This tarnished the base detergent granules with an unattractive, slightly yellowish color. Since the DTDMAC-TA intimate mixture is almost entirely water-insoluble, coating increased the amount of insolubles found on fabrics washed with those base detergent granules. A 2.4 insolubles grade was recorded for fabrics washed with these detergent compositions.

The base detergent granules sprayed at 80° F. and 125° F. were found to contain finite spherical particles of DTDMAC-TA mixture attached to the surfaces of the base detergent granules. No continuous coating of the base detergent granule with DTDMAC-TA mixture occurred. Granules sprayed at 80° F. and 125° F. were more soluble, registering an insolubles grade of 2.7 for fabrics washed in the detergent compositions sprayed at 80° F. These granules sprayed at 80° F. and 125° F. were the same color as unsprayed base granules, indicating that the spherical particles of DTDMAC-TA were not visible to the eye. This base granule appearance is more attractive than the appearance when the granules are coated with DTDMAC-TA mixture. At the same time, the base detergent granules sprayed at 80° F. and 125° F. were crisper than the base detergent granules sprayed at 180° F.

Next, the characteristics of the base detergent granules sprayed at 80° F. and 125° F. were compared against each other. Overall characteristics for both were good, except that the base detergent granules sprayed at 125° F. were observed to have a larger number of DTDMAC-TA spherical particles attached to the base granule surfaces. The DTDMAC-TA spherical particles were also observed to be smaller in size. This means that the spherical particles of DTDMAC-TA are less likely to chip off the base detergent granule surfaces because they are smaller and more numerous. The base detergent granules sprayed at 125° F. were observed to be crisper than the base detergent granules sprayed at 80° F., although both compositions had crisp granules.

Thus, this example demonstrates the criticality of the preferred ranges of the base granule temperature in achieving the formation of unique detergent-compatible antistatic compositions containing the quaternary ammonium—organic dispersion inhibitor particles attached to, but not coating, the detergent base granules.

EXAMPLE IX

A granular spray-on detergent composition was prepared according to the procedure outlined in Example II. Base detergent granules were sprayed with DTDMAC-TA mixture, then admixed with speckles and clay and sprayed with perfume.

The composition formed was as follows:

| | Parts |
|---|---|
| Base Detergent Granule | |
| Sodium ($C_{12}$) linear alkyl benzene sulfonate | 12.0 |
| Sodium ($C_{14-16}$) alkyl $ethoy_{1.0}$ sulfate | 6.0 |
| Sodium silicate (2.0 ratio) | 12.0 |
| Brightener | 0.294 |
| Coconut fatty acid | 0.5 |
| Sodium sulfosuccinate | 2.0 |
| Sodium carbonate | 5.0 |
| Sodium aluminosiliate (hydrated Zeolite A, 1-10μ) | 20.0 |
| Sodium sulfate | 16.26 |
| Moisture | 6.5 |
| TOTAL base detergent granule | 80.55 |
| Admix | |
| Perfume | 0.15 |
| Coconut alcohol $polyethoxylate_{6.0}$ | 0.25 |
| Speckles (spray-dried anionic detergent granules agglomerated with dyed polyethylene | |

-continued

| | Parts |
|---|---|
| glycol 6000) | 3.0 |
| Sodium montmorillonite clay (ion exchange capacity about 63 meq/100 g, commercially available from Georgia Kaolin Co., USA, under trade name BROCK | 8.0 |
| Spray-on Mixture | |
| Ditallowdimethylammonium chloride (DTDMAC) | 5.75 |
| Tallow alcohol | 2.01 |
| Miscellaneous and water | 0.29 |
| | 8.05 |
| TOTAL PARTS | 100.0 |

EXAMPLE X

A mixture of 6 parts DTDMAC, 2.1 parts tallow alcohol and 0.3 parts miscellaneous ingredients and water is melted to a temperature from about 200° F. to about 220° F. This molten mixture is fed through a concentric pipe two-fluid atomizer nozzle as previously described herein, where it is sprayed at a pressure of from about 20 psi to about 50 psi, along with air at a temperature from about 220° F. to about 250° F. and a pressure from about 80 psi to about 110 psi, onto base detergent granules in a mixing drum. The base detergent granules fall from the baffles into the path of the spray, and some of the granules fall from the baffles near the top of the mixing drum onto a protective hood covering the atomizer nozzle and then fall off the front end of the hood in a curtain into the path of the spray. The base detergent granules are passing in front of the atomizer nozzle orifice at a distance of from about 10 inches to about 15 inches, at a temperature from about 80° F. to about 120° F.

Once outside the spray nozzle orifice, the air breaks up the molten mixture of DTDMAC/TA into spherical particles which are partially frozen on contacting the base detergent granules, where they form separate, distinct generally spherical particles partially embedded in and attached to the base granule surfaces.

The base detergent granules are then admixed with clay, speckles, and sprayed with perfume and coconut alcohol polyethoxylate ($EO_{6.0}$). The composition produced is as follows:

| | Parts |
|---|---|
| Base Detergent Granule | |
| Sodium ($C_{12}$) linear alkylbenzene sulfonate | 12.0 |
| Sodium ($C_{14-16}$) alkyl ethoxy$_{1.0}$ sulfate | 6.0 |
| Sodium silicate (2.0 ratio) | 12.0 |
| Tallow fatty acid | 0.5 |
| Sodium tripolyphosphate | 23.07 |
| Brightener | 0.05 |
| Sodium sulfate | 21.63 |
| Moisture | 5.2 |
| TOTAL for base detergent granule | 80.45 |
| Admix | |
| Perfume | 0.15 |
| Sodium montmorillonite clay (ion exchange capacity about 63 meq/100 g, commercially available from Georgia Kaolin Co., USA, under the trade name BROCK) | 9.0 |
| Speckles | |
| Sodium tripolyphosphate | 1.48 |
| Moisture, dextrin glue, and minor components | 0.52 |
| | 2.0 |
| Spray-On Mixture | |
| Ditallowdimethylammonium chloride | 6.0 |
| Tallow alcohol | 2.1 |
| Miscellaneous and water | 0.3 |
| | 8.4 |
| TOTAL | 100.00 |

Comparable results are obtained when the base detergent granules are admixed with the clay and the speckles prior to the spraying of the spray-on mixture.

EXAMPLE XI

A molten intimate mixture of DTDMAC and tallow alcohol was sprayed along with air through a concentric pipe two-fluid atomizer as previously described herein onto base detergent granules at a temperature from about 80° F. to about 120° F. and at a spray distance from about 10 inches to about 15 inches. Samples A, B, C and D were produced by spraying the molten mixture and the air at different temperature and pressure conditions. The spray-on particle size was measured for each sample. An insolubles grade was assigned to each sample as previously described herein in Example IV.

The composition of each of the samples formed was as follows:

| | Parts |
|---|---|
| Base Detergent Granule | |
| Sodium ($C_{12}$) linear alkyl benzene sulfonate | 18.0 |
| Sodium silicate (1.6 ratio) | 7.0 |
| Sodium aluminosilicate (hydrated Zeolite A, particle diameter 1-10$\mu$) | 20.0 |
| Sodium carbonate | 10.0 |
| Sodium sulfate | 14.1 |
| Aluminium sulfate | 0.3 |
| Sodium acetate | 5.0 |
| Coconut alcohol polyethyoxylate ($EO_{6.0}$) | 0.25 |
| Brightener | 0.15 |
| Moisture | 6.0 |
| TOTAL base detergent granule | 80.8 |
| Perfume | 0.15 |
| Speckles (spray-dried anionic detergent granules agglomerated with dyed polyethylene glyol 6000) | 3.00 |
| Sodium montmorillonite clay (ion exchange capacity about 63 meq/100 g, commercially available from Georgia Kaolin Co., USA, under the trade name BROCK) | 8.00 |
| Spray-on Mixture | |
| Ditallowdimethyl ammonium chloride | 5.75 |
| Tallow alcohol | 2.01 |
| Miscellaneous and water | 0.29 |
| | 8.05 |
| TOTAL | 100.00 |

The results were as follows:

| SAMPLE | Spray Pressure, (psi) Air | Spray Pressure, (psi) Molten Mixture | Spray Temperature, (°F.) Air | Spray Temperature, (°F.) Molten Mixture | Particle Size Distribution (μ) Spray-on Particle 90% > | MEAN | 10% > | Insolubles Grade |
|---|---|---|---|---|---|---|---|---|
| A | 25 | 50 | 220 | 218 | >95 | >300 | >>400 | 2.0 |
| B | 52 | 50 | 219 | 218 | >75 | 290 | >400 | 1.9 |
| C | 106 | 50 | 225 | 226 | 50 | 145 | >340 | 2.3 |
| D | 100 | 20 | 214 | 229 | 55 | 110 | 270 | 2.4 |

This example demonstrates that spraying at temperatures and pressures within the preferred ranges produces spray-on particles within the preferred size range having superior solubility as evidenced by the higher insolubles grades of samples C and D. Criticality of the spray pressure of the air is shown in that when the air is sprayed at a pressure lower than the preferred range, larger spray-on particles than those preferred are produced. These larger particles tend to bounce off the base detergent granule instead of attaching to it because, being sprayed at a lower pressure, they have a longer time to solidify before reaching the detergent granules; and, even if they should become attached, they tend to chip off the base detergent granule surfaces because they are larger and fewer in number. In either event, the larger particles result in solubility grades which, while they are satisfactory for a detergent composition, are significantly poorer than those obtained using the preferred ranges, as evidenced by the lower insolubles grades of samples A and B. It can be appreciated that all the conditions of spraying similarly affect the spray-on characteristics of the product and that the spray conditions disclosed are critical for the formation of proper attachment of the spray-on particles.

What is claimed is:

1. A process for preparing a detergent product for conditioning fabrics comprising the steps of (a) mixing intimately (i) from about 80% to about 20% by weight of the particles of a quaternary ammonium compound of formula $[R_1R_2R_3R_4N]^+Y^-$ wherein at least one but not more than two of $R_1$, $R_2$, $R_3$, and $R_4$ is an organic radical containing a group selected from a $C_{16}$–$C_{22}$ aliphatic radical, or an alkyl phenyl or alkyl benzyl radical having 10 to 16 carbon atoms in the alkyl chain, the remaining group or groups being selected from $C_1$–$C_4$ alkyl, $C_2$–$C_4$ hydroxyalkyl, and $C_3$–$C_8$ cyclic structures in which the nitrogen atom or atoms form part of the ring, Y constituting an anionic radical selected from the group consisting of hydroxide, halide, sulfate, methylsulfate, ethylsulfate and phosphate ions, and (ii) from about 20% to about 80% by weight of a dispersion inhibitor, being a solid organic material having a solubility in water of 50 ppm maximum at 25° C. and a softening point in the range of 100° F. to 200° F., said material being selected from the group consisting of paraffinic waxes, cyclic and acyclic mono- and polyhydric alcohols, substituted and unsubstituted aliphatic carboxylic acids, esters of the foregoing alcohols and acids, $C_3$–$C_4$ alkylene oxide condensates of any of the foregoing materials and mixtures thereof, substantially all of said intimate mixture having a solubility in water of about 50 ppm maximum at 25° C. and having a softening point of about 100° F. to about 200° F., and (b) spraying said intimate mixture in a molten state at a temperature of from about 160° F. to about 250° F. and at a pressure of from about 10 psi to about 100 psi through a spray nozzle, and if said spray nozzle is a two-fluid atomizer nozzle, the second fluid is air at a temperature of from about 180° F. to about 270° F. and a pressure of from about 20 psi to about 150 psi, forming generally spherical particles from about 10 microns to about 500 microns in size, partially embedding in and attaching to spray-dried granules at a temperature of from about 50° F. to about 160° F. at a distance from about 6 inches to about 72 inches from said nozzle, so that the intimate mixture of the quaternary ammonium compound and the organic dispersion inhibitor comprises from about 3% to about 40% by weight, and the spray-dried granules comprise from about 97% to about 60% by weight, of the composition formed by the attachment, said spray-dried granules comprising (i) from about 99% to about 5% by weight of surfactant selected from the group consisting of anionic, nonionic, ampholytic and zwitterionic surfactants, and mixtures thereof, (ii) from about 1% to about 95% by weight of a mixture of (1) from about 1% to about 100% by weight of a detergency builder, and (2) up to about 99% by weight of an inert inorganic water-soluble salt.

2. The process of claim 1 where said spray nozzle is a two-fluid atomizer nozzle.

3. The process of claim 2 where said spray nozzle is a concentric pipe two-fluid atomizer nozzle.

4. The process of claim 2 where the intimate mixture is being sprayed at a temperature from about 180° F. to about 240° F. in step (b).

5. The process of claim 4 where the intimate mixture is being sprayed at a temperature from about 200° F. to about 220° F. in step (b).

6. The process of claim 4 where the spray-dried granules in step (b) are at a temperature from about 70° F. to about 140° F.

7. The process of claim 6 where the spray-dried granules in step (c) are at a temperature of from about 80° F. to about 120° F.

8. The process of claim 6 where the air is being sprayed in step (b) at a temperature from about 200° F. to about 260° F.

9. The process of claim 8 where the air is being sprayed in step (b) at a temperature from about 220° F. to about 250° F.

10. The process of claim 8 where the molten intimate mixture sprayed onto the spray-dried granules in step (b) comprises from about 3% to about 30% by weight, and the spray-dried granules comprise from about 97% to about 70% by weight, of the composition formed by the attachment.

11. The process of claim 10 where the molten intimate mixture sprayed onto the spray-dried granules in step (b) comprises from about 5% to about 25% by weight, and the spray-dried granules comprise from about 95% to about 75% by weight, of the composition formed by the attachment.

12. The process of claim 10 where the intimate mixture prepared in step (a) has a softening point of about 150° F. to about 175° F.

13. The process of claim 10 where the intimate mixture prepared in step (a) has a weight ratio of quaternary ammonium compound (i) to dispersion inhibitor (ii) from about 4:3 to about 4:1.

14. The process of claim 13 where the intimate mixture prepared in step (a) has a weight ratio of quaternary ammonium compound (i) to dispersion inhibitor (ii) from about 7:3 to about 4:1.

15. The process of claim 13 where the quaternary ammonium compound (i) is selected from ditallowdimethyl ammonium chloride, ditallowdimethyl ammonium methylsulfate, ditallowdimethyl ammonium ethyl sulfate, 1-methyl-1-[(tallowamido)ethyl]-2-tallowimidazolinium methylsulfate, and mixtures thereof.

16. The process of claim 15 where the dispersion inhibitor (ii) is selected from $C_{10}$–$C_{22}$ acyl sorbitan ester, tallow alcohol, and mixtures thereof.

17. The process of claim 16 where the dispersion inhibitor (ii) is a mixture of $C_{10}$–$C_{22}$ acyl sorbitan esters, the major components of which is one or more esters selected from the group consisting of sorbitan trilaurate, sorbitan trimyristate, sorbitan tripalmitate, sorbitan tristearate, sorbitan tetralaurate, sorbitan tetramyristate, sorbitan tetrapalmitate, sorbitan tetrastearate, and mixtures thereof.

18. The process of claim 16 where the quaternary ammonium compound (i) is ditallowdimethyl ammonium chloride.

19. The process of claim 18 where the dispersion inhibitor (ii) is tallow alcohol.

20. The process of claim 16 where the spray-dried granules onto which the intimate mixture is sprayed in step (b) comprise (i) from about 15% to about 75% by weight of an anionic surfactant selected from the group consisting of $C_{10-13}$ linear and branched alkyl benzene sulfonates, $C_{10-13}$ linear alkyl sulfates, $C_{10-20}$ alkyl polyoxyalkylene ether sulfates containing one to four oxyalkylene groups and mixtures thereof, (ii) from about 85% to about 25% by weight of a mixture of (1) from about 10% to about 99% by weight of a detergency builder, and (2) from about 1% to about 90% by weight of an inert organic water-soluble salt.

21. The process of claim 2 where the spray-dried granules are from about 6 inches to about 30 inches from said nozzle.

22. The process of claim 21 where the spray-dried granules are from about 8 inches to about 20 inches from said nozzle.

23. The process of claim 22 where the spray-dried granules are from about 10 inches to about 15 inches from said nozzle.

24. The process of claim 2 where the intimate mixture is being sprayed at a pressure from about 15 psi to about 75 psi in step (b).

25. The process of claim 24 where the intimate mixture is being sprayed at a pressure from about 20 psi to about 50 psi in step (b).

26. The process of claim 24 where the air is being sprayed in step (b) at a pressure from about 40 psi to about 120 psi.

27. The process of claim 26 where the air is being sprayed in step (b) at a pressure from about 80 psi to about 110 psi.

28. The process of claim 2 where the intimate mixture (a) is being sprayed at a temperature from about 200° F. to about 220° F. and the spray-dried granules are at a temperature from about 80° F. to about 120° F. and at a distance from about 10 inches to about 15 inches from the spray nozzle.

29. The process of claim 28 where the intimate mixture (a) is being sprayed at a pressure from about 20 psi to about 50 psi and the air is being sprayed at a temperature of about 220° F. to about 250° F. and a pressure of about 80 psi to about 110 psi.

30. The process of claim 1 where the intimate mixture is sprayed onto the spray-dried granules as the granules fall from elevated positions in a rotating mixing drum into the path of the spray.

31. The process of claim 30 where some of the granules fall from elevated positions onto a protective hood covering a spray nozzle and then off the front end of the hood into the path of the spray.

* * * * *